US008491080B2

(12) United States Patent
Sakurada et al.

(10) Patent No.: US 8,491,080 B2
(45) Date of Patent: Jul. 23, 2013

(54) RECORDING DEVICE, CONTROL METHOD, AND RECORDING MEDIUM

(75) Inventors: Yuichi Sakurada, Yokohama (JP); Nobuyuki Satoh, Yokohama (JP); Masato Kobayashi, Yokohama (JP); Tomonori Kimura, Kawasaki (JP); Arata Suzuki, Zushi (JP); Yasuo Sakurai, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 508 days.

(21) Appl. No.: 12/659,213

(22) Filed: Mar. 1, 2010

(65) Prior Publication Data

US 2010/0225693 A1 Sep. 9, 2010

(30) Foreign Application Priority Data

Mar. 3, 2009 (JP) ..... 2009-049926

(51) Int. Cl.
*B41J 29/38* (2006.01)

(52) U.S. Cl.
USPC ..... 347/14; 347/15; 347/19

(58) Field of Classification Search
USPC ..... 347/14, 15, 19
See application file for complete search history.

(56) References Cited

U.S. PATENT DOCUMENTS

| | | | | |
|---|---|---|---|---|
| 7,581,801 | B2 | 9/2009 | Oike | |
| 2004/0036731 | A1 | 2/2004 | Ready et al. | |
| 2004/0075708 | A1 * | 4/2004 | Arakawa | 347/19 |
| 2004/0179885 | A1 * | 9/2004 | Adkins et al. | 400/636.1 |
| 2006/0050099 | A1 * | 3/2006 | Murakami et al. | 347/19 |
| 2008/0068418 | A1 * | 3/2008 | Yoshida et al. | 347/16 |

FOREIGN PATENT DOCUMENTS

| | | |
|---|---|---|
| JP | 11-020263 | 1/1999 |
| JP | 2007-261262 | 10/2007 |
| JP | 4296043 | 4/2009 |

OTHER PUBLICATIONS

Abstract of JP2004-358759 Published on Dec. 24, 2004.
U.S. Office Action dated Mar. 6, 2012, issued in co-pending U.S. Appl. No. 12/659,560.
U.S. Office Action dated Aug. 15, 2012, issued in co-pending U.S. Appl. No. 12/659,560.

* cited by examiner

*Primary Examiner* — Laura Martin
(74) *Attorney, Agent, or Firm* — Harness, Dickey & Pierce P.L.C.

(57) ABSTRACT

A recording device including a paper feeder tray that accommodated a recording medium, a print head that discharges ink on the recording medium to record an image thereon, a transfer roller that transfers the recording medium and a printed test chart on which multiple marks are arranged, a control device that controls the transfer roller, a first detection device that detects a rotation position of the transfer roller, a second detection device that detects the multiple marks arranged on the printed test chart, and a transfer device that transfers the recording medium from the paper feeder tray to the second detection device, wherein the control device obtains an difference between an actual transfer amount of each of the multiple marks obtained by detecting the multiple marks by the second detection device and a predetermined theoretical transfer amount of each of the multiple marks relating to a rotation position of the transfer roller, calculates a correction amount for the rotation amount of the transfer roller based on a relationship between the rotation position of the transfer roller and the difference, and controls the rotation amount of the transfer roller using the correction amount.

10 Claims, 15 Drawing Sheets

ROLLER OF A
TRUE CIRCLE

ROLLER OF AN
IRREGULAR FORM

FIG. 11

| COUNT VALUE | ENCODER VALUE |
|---|---|
| 1 | $\alpha$ |
| 2 | $\beta$ |
| 3 | $\gamma$ |
| · | · |
| · | · |
| N | $\zeta$ |

FIG. 12

| COUNT VALUE | ENCODER VALUE | TRANSFER AMOUNT (COUNT VALUE × LINE GAP; l) | ROTATION ANGLE OF TRANSFER ROLLER (ENCODER VALUE/A) × 360 A; ENCODER VALUE OF ONE ROTATION CYCLE OF TRANSFER ROLLER |
|---|---|---|---|
| 1 | $\alpha$ | 1 × l | ($\alpha$/A) × 360 |
| 2 | $\beta$ | 2 × l | ($\beta$/A) × 360 |
| 3 | $\gamma$ | 3 × l | ($\gamma$/A) × 360 |
| · | · | · | · |
| · | · | · | · |
| N | $\zeta$ | N × l | ($\zeta$/A) × 360 |

RECORDING DEVICE, CONTROL METHOD, AND RECORDING MEDIUM

BACKGROUND OF THE INVENTION

1. Field of the Invention

The present invention relates to recording devices such as an ink jet printer.

2. Discussion of the Background

A recording device employing an ink jet system records an image on a recording medium by discharging ink from a print head while moving the print head back and forth in the primary scanning direction to cause the ink to attach to the recording medium. Then, the recording medium is conveyed in the sub-scanning direction by transfer rollers, etc. to repeat recording in the main scanning direction and form the image on the recording medium.

However, the system of conveying a recording medium by transfer rollers involves a problem such that the assembly and eccentricity of the transfer rollers affect transfer (conveyance) of the recording medium. When the transfer amount of the recording medium varies, the image is formed at a position different from the target (ideal, theoretical) recording position on the recording medium.

Therefore, a technology that tried to deal with such a problem describes a method of adjusting the rotation of a transfer roller by recording a test pattern on a recording medium and detecting the shift amount of the recording medium along the transfer direction thereof based on the test pattern.

However, the accuracy of the test pattern on a recording medium in the technology depends on the status of nozzles, which may lead to droplet missing, droplet shifting, etc. Therefore, this rotation adjustment of a transfer roller results in an erroneous adjustment if the rotation is adjusted according to data obtained from such an inaccurate test pattern.

Because of these reasons, the present inventors recognize that a need exists for a recording device, a control method and a program by which the variation of rotation amount of a transfer roller is reduced along the sub-scanning direction even when nozzle problems cause droplet missing, droplet shifting, etc.

Accordingly, an object of the present invention is to provide a recording device, a control method and a program by which the variation of rotation amount of a transfer roller is reduced when nozzle problems cause droplet missing, droplet shifting, etc.

Briefly this object and other objects of the present invention as hereinafter described will become more readily apparent and can be attained, either individually or in combination thereof, by a recording device including a paper feeder tray that accommodated a recording medium, a print head that discharges ink on the recording medium to record an image thereon, a transfer roller that transfers the recording medium and a printed test chart on which multiple marks are arranged, a control device that controls the transfer roller, a first detection device that detects a rotation position of the transfer roller, a second detection device that detects the multiple marks arranged on the printed test chart, and a transfer device that transfers the recording medium from the paper feeder tray to the second detection device, wherein the control device obtains a difference between an actual transfer amount of each of the multiple marks obtained by detecting the multiple marks by the second detection device and a predetermined theoretical transfer amount of each of the multiple marks relating to a rotation position of the transfer roller, calculates a correction amount for the rotation amount of the transfer roller based on a relationship between the rotation position of the transfer roller and the difference, and controls the rotation amount of the transfer roller using the correction amount.

It is preferred that, in the recording device mentioned above, based on the relationship between the rotation position of the transfer roller and the difference, the control device determines a first difference with regard to a current rotation position of the transfer roller and a second difference with regard to the position after rotation of the transfer roller, and calculates the correction amount from the difference between the first difference and the second difference.

It is still further preferred that, in the recording device mentioned above, the control device controls the transfer roller such that the rotation amount of the transfer roller matches the actual rotation amount thereof, the actual rotation amount of the transfer roller obtained by subtracting the correction amount from the theoretical rotation amount of the transfer roller between the current rotation position of the transfer roller and the position after rotation.

It is still further preferred that, in the recording device mentioned above, the printed test chart is overlapped on the recording medium before the printed test chart is transferred to the second detection device.

It is still further preferred that, in the recording device mentioned above, the control device corrects the actual transfer amount of each of the multiple marks according to the layer thickness of the printed test chart.

It is still further preferred that the recording device mentioned above further includes a second paper feeder tray that accommodates the printed test chart, and a second transfer device that transfers the printed test chart accommodated in the second paper feeder tray to the second detection device.

It is still further preferred that, in the recording device mentioned above, the control device corrects the actual transfer amount of each of the multiple marks depending on the difference between the layer thickness of the printed test chart and the layer thickness of the recording medium.

It is still further preferred that, in the recording device mentioned above, when the second detection device detects the multiple marks arranged on the printed test chart that is transferred askew with an angle, the control device corrects the actual transfer amount of each of the multiple marks depending on the angle.

It is still further preferred that, in the recording device mentioned above, when the number of counts of the marks detected by the second detection device is less than a predetermined number of counts, the control device determines that the second detection device detects the printed test chart transferred askew with the angle.

It is still further preferred that, in the recording device mentioned above, the control device identifies the angle from the difference between the number of counts of the marks detected by the second detection device and a predetermined number of counts and corrects the actual transfer amount of each of the multiple marks according to the angle identified.

As another aspect of the present invention, a method of controlling a device that forms images with a print head that discharges ink on a recording medium, includes firstly detecting the rotation position of a transfer roller that transfers the recording medium, secondly detecting multiple marks arranged on a printed test chart that is used to adjust a transfer amount of the transfer roller and controlling the transfer roller that includes firstly calculating an difference between an actual transfer amount of each of the multiple marks obtained by a step of secondly detecting rotation position, and a predetermined theoretical transfer amount of each of the multiple marks relating to the rotation position of the transfer roller, secondly calculating a correction amount to correct the transfer amount of the transfer roller based on a relationship between the rotation position of the transfer roller and the difference, and controlling the transfer amount of the transfer roller using the correction amount.

As another aspect of the present invention, a computer-readable recording medium storing a computer program for executing a method of recording an image on a recording medium with a print head that discharges ink is provided in which the method includes firstly detecting the rotation position of a transfer roller that transfers the recording medium, secondly detecting multiple marks arranged on a printed test chart that is used to adjust a transfer amount of the transfer roller, and controlling the transfer roller including firstly calculating the difference between an actual transfer amount of each of the multiple marks obtained by a step of secondly detecting rotation position, and a predetermined theoretical transfer amount of each of the multiple marks relating to the rotation position of the transfer roller, secondly calculating a correction amount to correct the transfer amount of the transfer roller based on the relationship between the rotation position of the transfer roller and the difference and controlling the transfer amount of the transfer roller using the correction amount.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

FIG. 11 is a diagram illustrating a table structure example of the count value and the encoder value;

FIG. 12 is a diagram illustrating a table structure example of the transfer amount and the rotation angle of the transfer roller;

DETAILED DESCRIPTION OF THE INVENTION

The present invention will be described below in detail with reference to several embodiments and accompanying drawings.

The present invention will be described below in detail with reference to several embodiments and accompanying drawings. First, the recording device of the first embodiment is described with reference to FIGS. 5, 6, 8 and 13.

The recording device of this embodiment is structured to have a (first) paper feeder tray 300 that accommodates the recording medium 16. The structure and the control of the paper feeder tray 300 are known and thus descriptions of specific mechanism and control process thereof are omitted.

Figure 5:
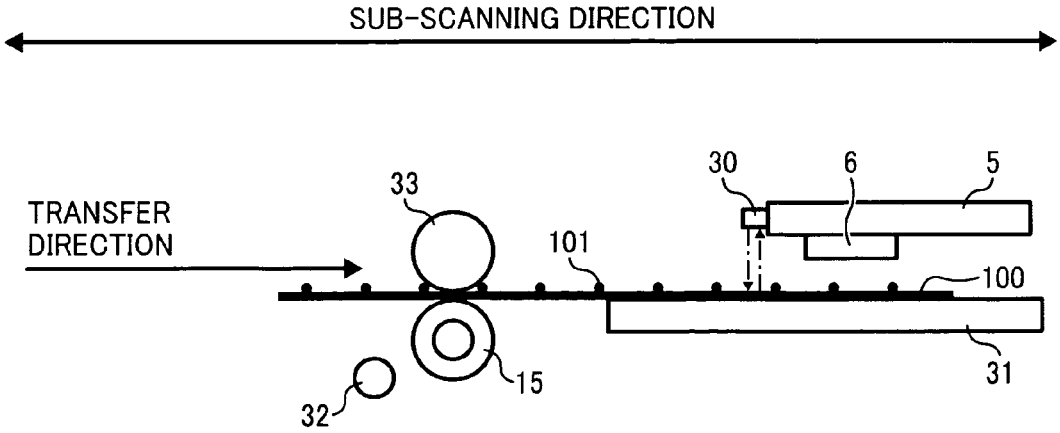
FIG. 5 is a diagram illustrating a schematic structure example of the mechanism of the recording device of the first embodiment described below.
Figure 6:
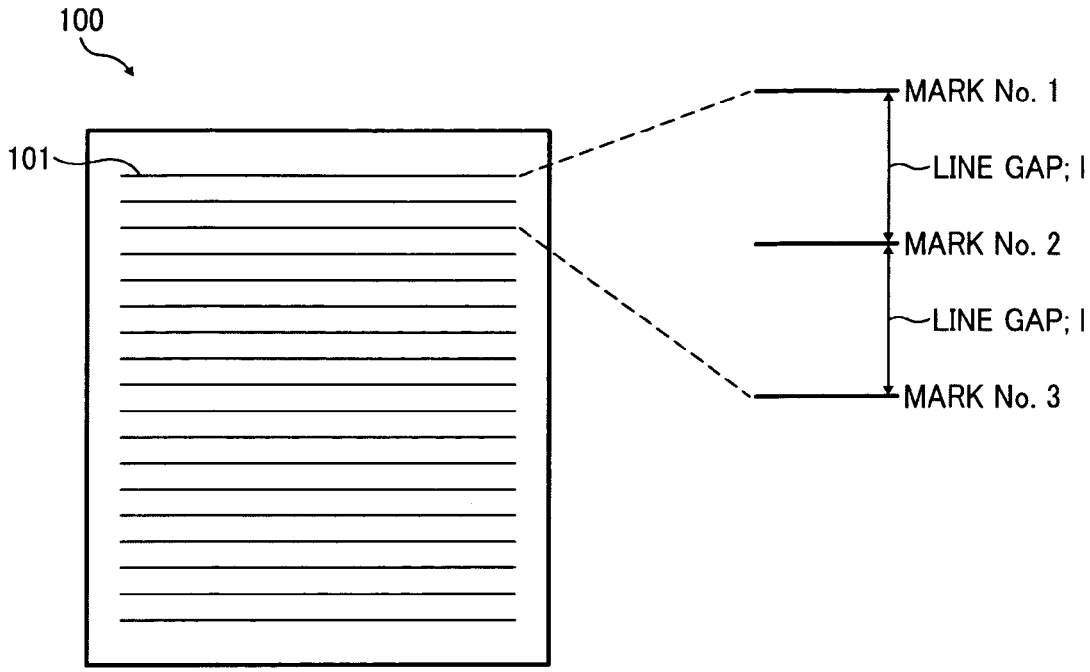
FIG. 6 is a diagram illustrating a structure example of the printed test chart 100, which is described later.

FIG. 5 is a diagram illustrating a configuration example of the mechanical part in the recording device for use in detection of marks 101 arranged on a printed test chart 100 illustrated in FIG. 6. The test chart 100 is made before it is set in the recording device.

FIG. 6 is an example of the printed test chart 100 for use in rotation adjustment of a transfer roller 15 (transfer amount of a recording medium 16 by the transfer roller 15).

Figure 8:
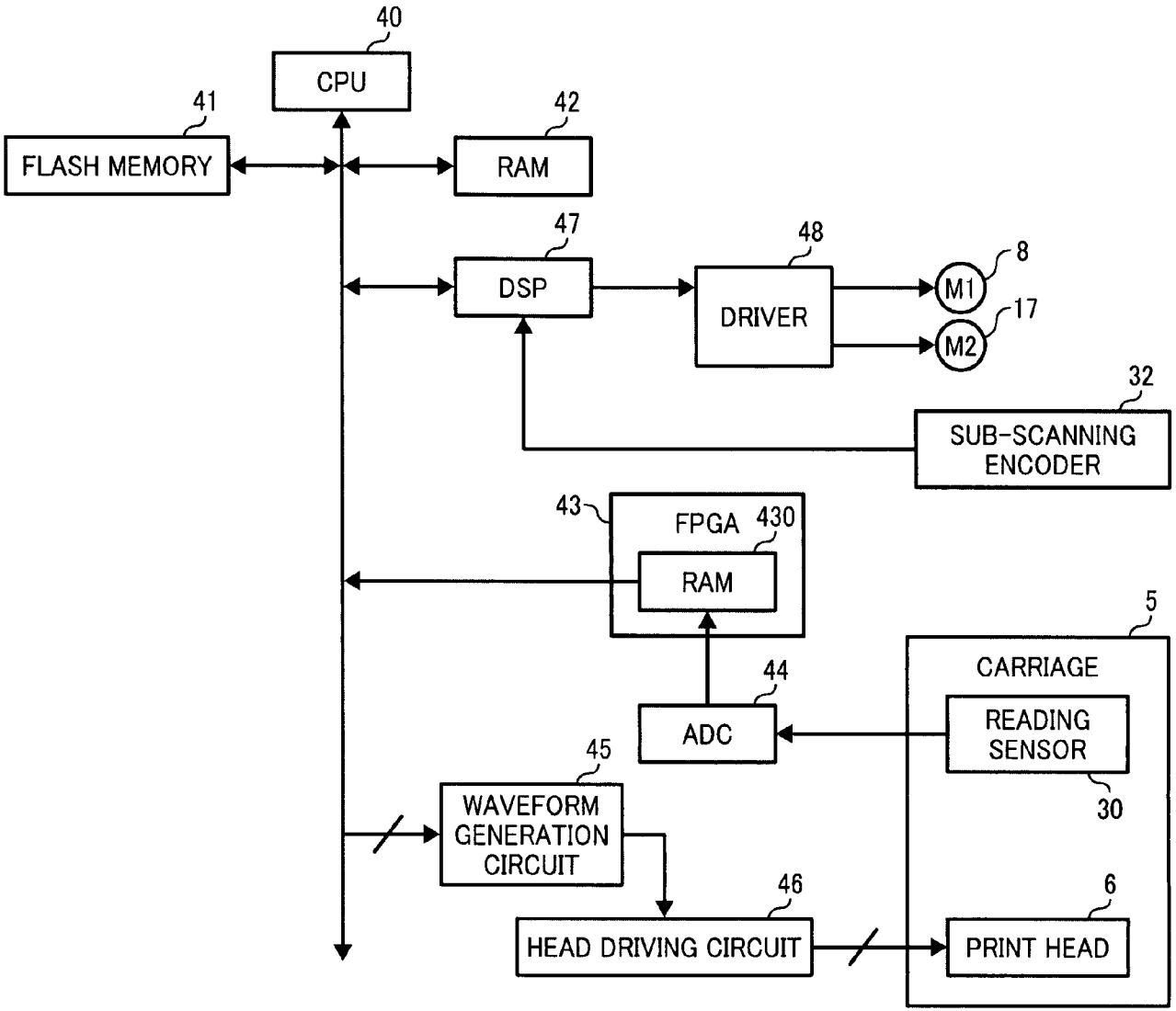
FIG. 8 is a diagram illustrating a structure example of the control mechanism of the recording device of the first embodiment.

FIG. 8 is a diagram illustrating a structure example of the control mechanism of the recording device and FIG. 13 is a graph illustrating a calculation method of the transfer difference of the transfer roller 15.

The recording device of this embodiment records an image on the recording medium 16 using a print head 6 that ejects ink.

Figure 1:
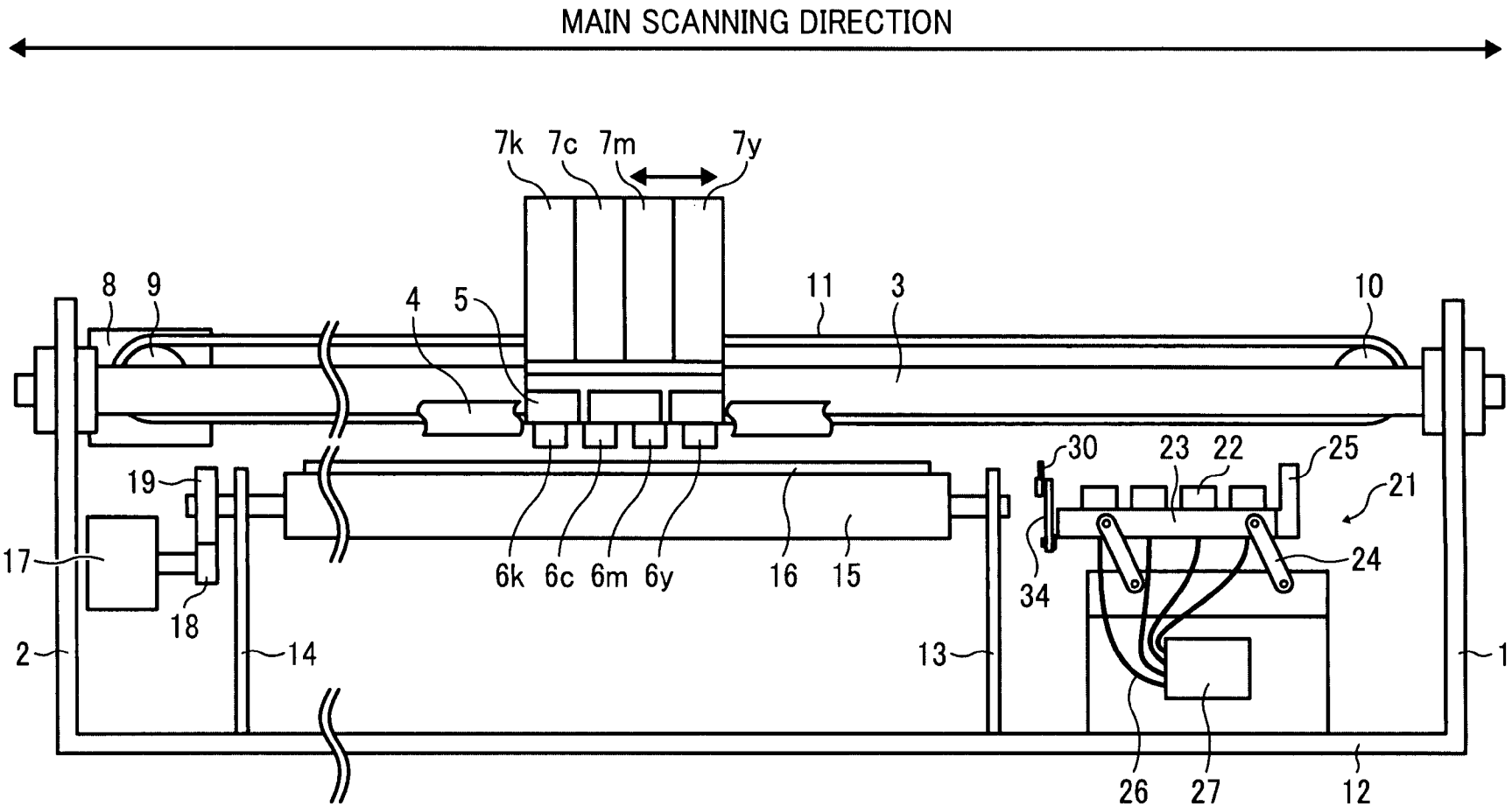
FIG. 1 is a schematic structure example of the mechanism of the recording device of the present invention.

As in FIGS. 1 and 8, the recording device of the embodiment is structured to have the transfer roller 15 that transfers the recording medium 16, a control unit CPU 40 that controls the transfer roller 15, a first detection device (sub-scanning encoder 32, DSP 47) that detects the rotation position of the transfer roller 15, and a second detection device (reading sensor 30) that detects multiple marks 101 arranged on the printed test chart 100 when the printed test chart 100 for use in rotation adjustment of the transfer roller 15 is transferred by the transfer roller 15.

The control unit CPU 40 in this embodiment obtains the difference (difference) between the actual transfer amount of each mark 101 by the transfer roller 15 detected by the second detection device (reading device 30) and the theoretical transfer amount thereof relating to the rotation position of the transfer roller 15 and then calculates the correction amount of the rotation amount of the transfer roller 15 based on the relationship (shown in FIG. 13 (B)) between the rotation position of the transfer roller 15 and the difference to control the rotation amount of the transfer roller 15 using the correction amount.

Therefore, the recording device of the embodiment can reduce the variation in the transfer amount of the recording medium 16 by the transfer roller 15 in the sub-scanning direction even when problems caused by nozzles such as droplet missing and droplet shifting occur.

The recording device of this embodiment is described below in detail with reference to several embodiments and accompanying drawings.

First Embodiment

Schematic Structure of Mechanism of Recording Device

The schematic structure of the mechanism of the recording device of this embodiment is described below in detail with reference to FIG. 1.

The recording device of this embodiment includes a main support guide rod 3 and a sub-support guide rod 4 provided in substantially parallel thereto between side plates 1 and 2. The rods 3 and 4 support a carriage 5 such that the carriage 5 slidably moves in the main scanning direction.

The carriage 5 has four print heads 6*y*, 6*m*, 6*c* and 6*k* that discharge yellow (Y) ink, magenta (M) ink, cyan (C) ink, and black (Bk), respectively, with the discharging surfaces (nozzle phase) thereof downward.

In addition, the carriage 5 includes replaceable four ink cartridges 7 (which means any or all of 7*y*, 7*m*, 7*c* and 7*k*) provided above the print head 6 (which means any or all of 6*y*, 6*m*, 6*c* and 6*k*). The ink cartridge 7 supplies inks corresponding to the four print heads 6. The carriage 5 is connected to a timing belt 11 suspended between a driving pully 9 (drive timing pully) that is rotated by a main scanning motor 8 and a driven pully (idler pully) 10 so that the carriage 5 moves in the main scanning direction by drive-control of the main scanning motor 8.

In addition, the recording device of the embodiment includes a base plate 12, which connects the side plates 1 and 2. Sub-frames 13 and 14 are provided onto the base plate 12 and support the transfer roller 15 that rotates. A sub-scanning motor 17 is provided on the side of the sub-frame 14. A gear 18 is provided fixed onto the rotation axis of the sub-scanning motor 17 and a gear 19 is provided fixed onto the axis of the transfer roller 15 to convey the rotation of the sub-scanning motor 17 to the transfer roller 15.

In addition, a reliability maintenance and recovery mechanism 21 (hereinafter referred to as subsystem) for the print head 6 is provided between the side plate 1 and the sub-frame 12. The sub-system 21 holds four capping devices that caps the discharging phase of the print head 6 with a holder 23 and holds the holder 23 with a link member 24 in a shakable manner. The carriage 5 moves in the main scanning direction and when the carriage 5 contacts with an engagement portion 25 provided to the holder 23, the holder 23 is lift up to cap the discharging phase of the print head 6 by a capping device 22.

In addition, when the carriage 5 moves onto the side of the print area, the holder 23 is lift down so that the capping device 22 is detached from the discharging phase of the print head 6.

The capping device 22 is connected to a suction pump 27 via a suction tube 26 and forms an air opening to communicate with air via an air release tube and an air release valve. In addition, the suction pump 27 suctions waste ink and discharges it to a liquid waste tank.

In addition, on the lateral of the holder 23, a wiper blade 30 that wipes off the discharging phase of the print head 6 is attached to a blade arm 34. The axis of the blade arm 34 is supported in such a manner that the blade arm 34 can swing by rotation of a cam rotated by a driving force (not shown).

The recording device of this embodiment illustrated in FIG. 1 discharges ink from the print head 6 while moving the print head 6 back and forth in the primary scanning direction and causes the ink to attach to the recording medium 16 to record an image thereon. Then, the recording medium 16 is conveyed in the sub-scanning direction by the transfer roller 15, etc. to let recording of an image continue (repeat) in the primary scanning direction and form the entire image on the recording medium 16.

However, a slight deviation occurs with regard to the transfer amount of the recording medium 16 when the recording medium 16 is conveyed by rotating the transfer roller 15. The position on which an image is actually recorded is the result of the actual transfer in a predetermined amount of the recording medium 16 by the transfer roller 15. Thus the position is shifted from the ideal position (the target recording position where the image should be recorded on the recording medium 16).

This transfer shift (deviation) is mainly ascribable to the recording medium 16 and the transfer roller 15.

The transfer shift caused by the recording medium 16 is described first.

The transfer shift relating to the recording medium 16 is caused by, for example, the condition that changes the contact status and the friction status between the recording medium and the transfer roller 15. Specific examples thereof include, but are not limited to, the width of the recording medium 16 (having a size of from, for example, A0 to A5), the thickness, and the friction coefficient.

The deviation on the transfer amount of the recording medium is preferably corrected by respective conditions of the size, thickness, kind, paper quality, etc. of the recording medium 16 since the conditions of the transfer roller 15 are fixed in the recording device.

The transfer shift caused by the transfer roller 15 is described next.

Figure 2:
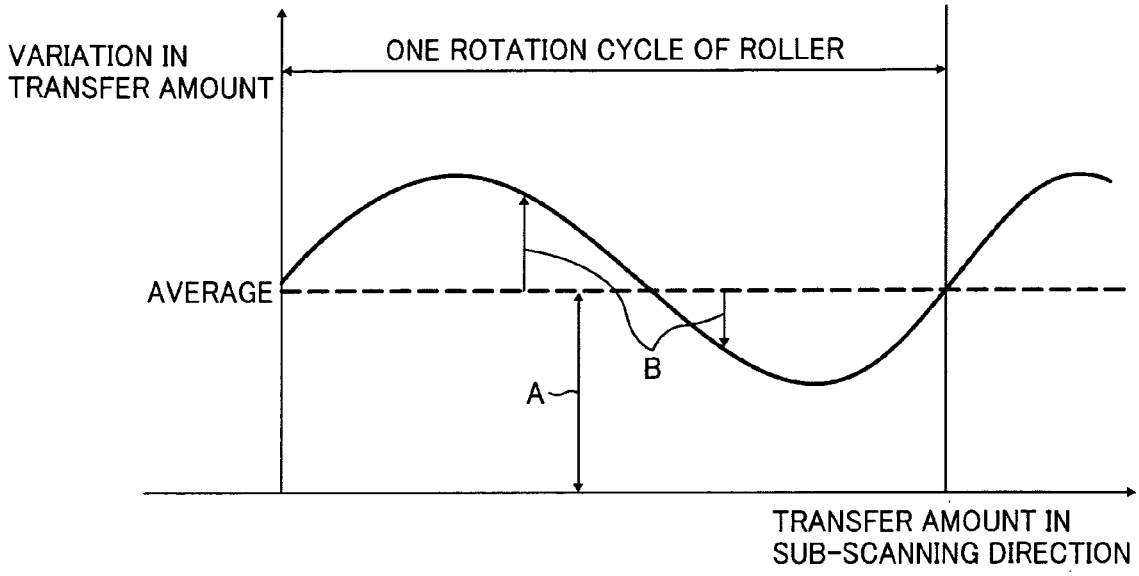
FIG. 2 is a graph illustrating variation in transfer amount by a transfer roller in one cycle thereof.

FIG. 2 is a diagram illustrating the variation of the transfer amount by the transfer roller 15.

In FIG. 2, the Y axis represents the transfer variation and the X axis represents the transfer amount.

As seen in FIG. 2, the transfer amount of the recording medium 16 can be described by the following two compositions.

The first is the fixed composition (i.e., "A" illustrated in FIG. 2) in the roller rotation that depends on the kind of the recording medium 16, the recording device, and the environment.

The second is the variation component (i.e., "B" illustrated in FIG. 2) that relates to one cycle of the roller rotation that depends on the roller precision, the deflection of the roller, and the assembly of the roller support portion.

The transfer amount of the recording medium 16 is obtained by addition of the two components and can be approximated.

Since the fixed component ("A" in FIG. 2) depends on the usage environment, the registration should be adjusted in the actual recording environment. On the other hand, the variation component ("B" in FIG. 2) depends on an individual device so that the adjustment is preferably conducted at one time, for example, at the time of shipment.

FIG. 3 is a diagram illustrating the variation in the transfer amount of the recording medium 16 caused by the difference in the form (cross section) of the transfer roller 15. In this case, the rotation angle of the transfer roller 15 that transfers the recording medium 16 is assumed to be constant.

Figure 3A:
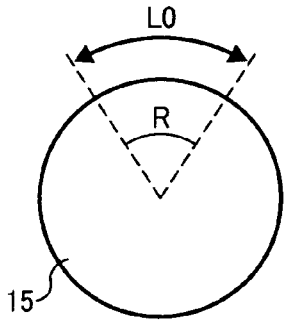
FIG. 3 is a diagram illustrating the difference in transfer amount by the a transfer roller depending on the forms thereof.

When the cross section of the transfer roller 15 is a true circle, the transfer amount is the same (i.e., L0) at any position as illustrated in FIG. 3A when the transfer roller 15 is rotated at an angle of "R".

Figure 3B:
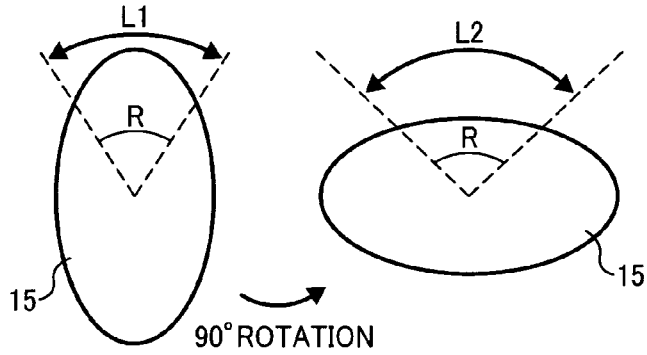

However, when the cross section of the transfer roller 15 is an irregular form, the transfer amount varies depending on the rotation position of the transfer roller 15 when the transfer roller 15 is rotated at an angle of "R". For example, as illustrated in FIG. 3B, when the cross section of the transfer roller 15 is an ellipse, the transfer roller 16 is transferred in an amount of L1 at a position.

The recording medium 16 is transferred in an amount of L2 at another position. In this case, the following relationship is satisfied: L1>L0>L2, and thus the transfer variation occurs depending on the roller cycle.

The transfer amounts of L0, L1, and L2 almost match the length of the arcs for the angle "R".

Such a transfer amount variation occurring depending on the roller cycle affects the quality of a resultant printed image. That is, when the transfer amount varies depending on the roller cycle, the landing position of the droplets has a bias depending on the rotation position of the transfer roller 15.

The mechanism of the variation component on the transfer amount relating to one cycle of the transfer roller 15 is described above with reference to FIG. 3 using the difference in the cross sections of the transfer rollers 15 (i.e., a true cycle or an ellipse).

The cause of the variation component is not limited to the cross section of the transfer roller 15. For example, the eccentricity of the rotation axis of the transfer roller 15, the deflection of the transfer roller 15, and swelling of the transfer roller 15 due to the temperature and the humidity of the surrounding may lead to the occurrence of the variation component.

The impact on the recording caused by the variance in the transfer amount depending on the roller cycle is described next.

When the position of the transfer roller 15 is at L1 as illustrated in FIG. 3B, the transfer amount of the recording medium 16 is greater than usual. Therefore, an image is recorded below (relative to the transfer direction) the position where the image should be recorded.

When the position of the transfer roller 15 is at L2 as illustrated in FIG. 3B, the transfer amount of the recording medium 16 is less than usual. Therefore, an image is recorded above (relative to the transfer direction) the position where the image should be recorded.

Therefore, an image having a uniform density results in a shading image.

This uneven density significantly stands out in the case of a simple image such as a background of a landscape, which is a disadvantage in terms of quality printing.

Generally, adjustment on the transfer amount represents adjustment with regard to the fixed component (refer to "A" in FIG. 2), which depends on the kind of the recording medium 16, the recording device, and the environment.

Also, deviation in the transfer amount is typically detected and obtained by using the adjustment pattern and used as the transfer adjustment value.

However, due to the variation component described above, the position where the value of the fixed component is obtained changes depending on the timing of the registration adjustment operation.

Figure 4:
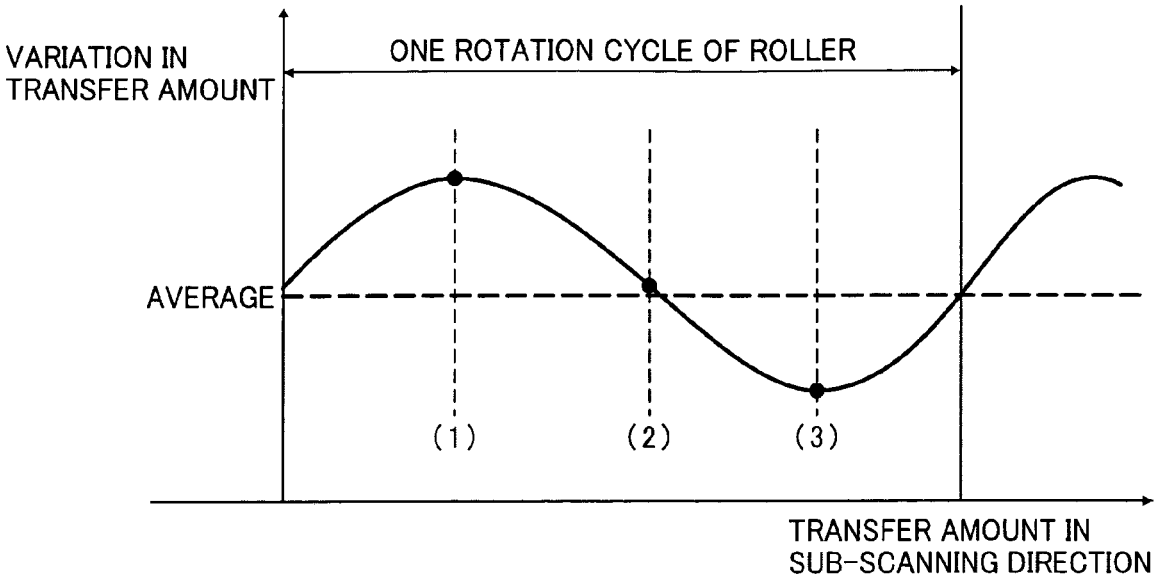
FIG. 4 is a diagram illustrating the variation of the transfer amount (rotation angle) depending on the position' (phase) of a transfer roller.

FIG. 4 is a diagram illustrating the variation of the transfer amount according to the position (phase) of the transfer roller 15. When the registration is adjusted at the position (1) in FIG. 4, the obtained adjustment value is greater than the fixed component. When the registration is adjusted at the position (3) in FIG. 4, the obtained adjustment value is smaller than the fixed component. A significantly correct adjustment value corresponding to the fixed component can be obtained by detecting and calculating the transfer amount adjustment value at the position (2) in FIG. 4.

However, since the variation component is dependent on the roller precision, the deflection of the roller, and the assembly of the roller support portion, the position is generally difficult to identify.

However, as described above, the transfer amount varies with a cycle corresponding to one rotation of the transfer roller 15. Particularly, as illustrated in FIG. 2, if the variation cycle can be approximated by a cycle of a sin curve, the variation between the two positions corresponding to the ½ rotation of the transfer roller 15 are the same in absolute value with a positive and negative difference.

The recording device of this embodiment detects the variation of the transfer amount caused by the transfer roller 15 and controls the driving thereof based on the detection results. Therefore, the recording device of the embodiment detects marks (e.g., lines) arranged on a printed test chart, which is described later, and the variation of the transfer amount by the transfer roller 15 based on the gap between the detected marks.

According to the detection results, driving of the transfer roller 15 is controlled to adjust the variation of the transfer amount.

Structure Example of Mechanical Portion of Recording Device for Use in Detection of Marks Arranged on Test Chart A structure example of the mechanism of the recording device for use in detection of marks arranged on the printed test chart is described next with reference to FIG. 5.

The printed test chart is used for adjustment of the transfer amount by the transfer roller 15 along the sub-scanning direction and structured as illustrated in FIG. 6.

The printed test chart 100 illustrated in FIG. 6 has ruled lines (marks) 101 with the same gap therebetween. The marks 101 are arranged with the same gap of "1" therebetween.

The recording device of the embodiment includes the carriage 5, a platen board 31, a transfer roller 15, a sub-scanning encoder 32, and a driven roller 33 as illustrated in FIG. 5.

The carriage 5 is structured to have the reading sensor 30. The reading sensor 30 detects the mark 101 arranged on the printed test chart 100 illustrated in FIG. 6.

Figure 7:
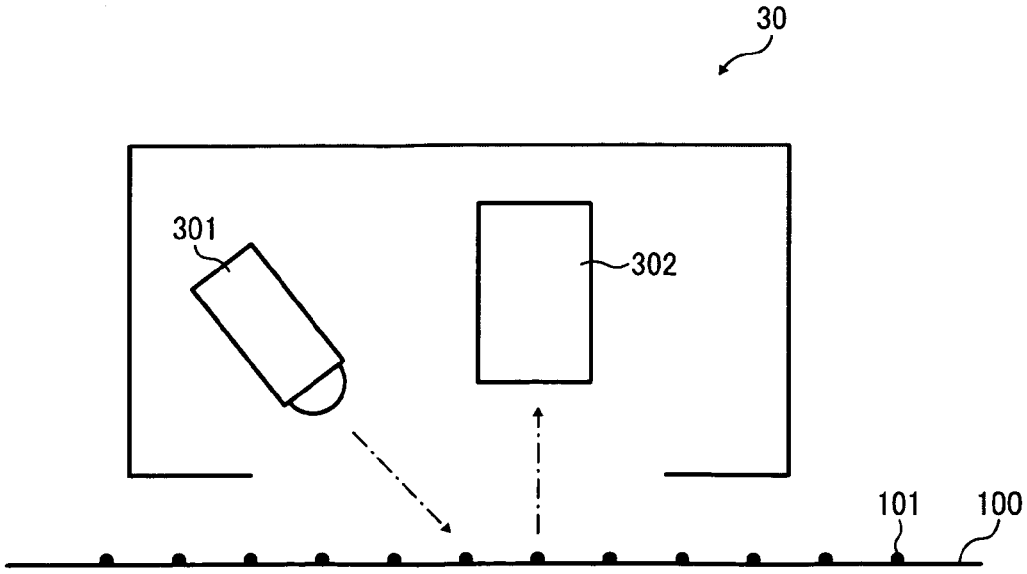
FIG. 7 is a diagram illustrating a structure example of a reading sensor 30.

The reading sensor 30 is structured to have a reflection type optical sensor and includes a luminous portion 301 and a light reception portion 302 as illustrated in FIG. 7.

The luminous portion 301 emits light and the light therefrom is reflected at the surface of the printed test chart 100.

The light reception portion 302 detects the amount of the reflection light (intensity of the reflection light) reflected at the surface of the printed test chart 100.

The reading sensor 30 detects the mark 101 arranged on the printed test chart 100 based on the amount of reflection light detected by the light reception portion 302.

Any structure of the reading sensor 30 and any detection method thereby that can detect the mark 101 arranged on the printed test chart 100 can be suitably used.

In addition, there is no specific limit to the placement of the reading sensor 30 and thus the reading sensor can be placed at an arbitrary position.

For example, the reading sensor 30 can be integrally arranged with the print head 6 and also can be placed on the extension of the nozzles of the print head 6.

The platen board 31, the transfer roller 15 and the driven roller 33 transfer the printed test chart 100.

The sub-scanning encoder 32 is to output encoder signals according to the rotation angle of the transfer roller 15. The encoder signal is input into DSP (not shown) and the encoder value is counted thereby.

In the recording device of this embodiment, the printed test chart 100 provided on the platen board 31 is transferred along the sub-scanning direction by the transfer roller 15 and then the reading sensor 30 detects the mark 101 arranged on the printed test chart 100.

Then, the transfer amount of the printed test chart 100 is calculated according to the detection signal detected by the reading sensor 30. Furthermore, the reading sensor 30 calculates the rotation angle (rotation position) of the transfer roller 15 based on the encoder value counted by the DSP when the reading sensor 30 detects the mark 101. For example, when the transfer roller 15 rotates one cycle, the sub-scanning encoder 32 is assumed to count 38,400. The encoder value per 1 degree of the rotation angle of the transfer roller 15 is obtained as nearly 107 (=38,400/360).

When the encoder value counted by the DSP is 3,840, the rotation angle of the transfer roller 15 is obtained as close to 74.8 (=3,840/107).

Structure Example of Control Mechanism of Recording Device

Next, a structure example of the control mechanism of the recording device of this embodiment is described next in detail with reference to FIG. 8.

The control mechanism of the recording device of the embodiment includes the central processing unit (CPU) 40, a flash memory 41, a random access memory (RAM) 42, a field programmable gate array (FPGA) 43, the sub-scanning encoder 32, the carriage 5, an analog digital converter (ADC) 44, a waveform generation circuit 45, a head driving circuit 46, the digital signal processor (DSP) 47, a driver 48, a main scanning motor 8, and a sub-scanning motor 17.

The CPU 40 controls the entire of the recording device. The flash memory 41 saves necessary information. The RAM 42 is used as a working memory.

FPGA 43 is a large scale integration (LSI) for arbitrary programming and has an RAM 430.

The waveform generation circuit 45 generates a driving waveform applied to a piezoelectric element (not shown) of the print head 6.

The head driving circuit 46 applies the driving waveform output from the waveform generation circuit 45 to the piezoelectric element (not shown) to drive the print head 6.

The driver 48 drive-controls the main scanning motor 8 and the sub-scanning motor 17 according to the driving information (information on voltage, etc.) provided via the DSP 47 to move the carriage 5 in the main scanning direction, or rotate the transfer roller 15 to transfer the recording medium 16 with a predetermined distance.

Processing Operation of Recording Device

Figure 9:
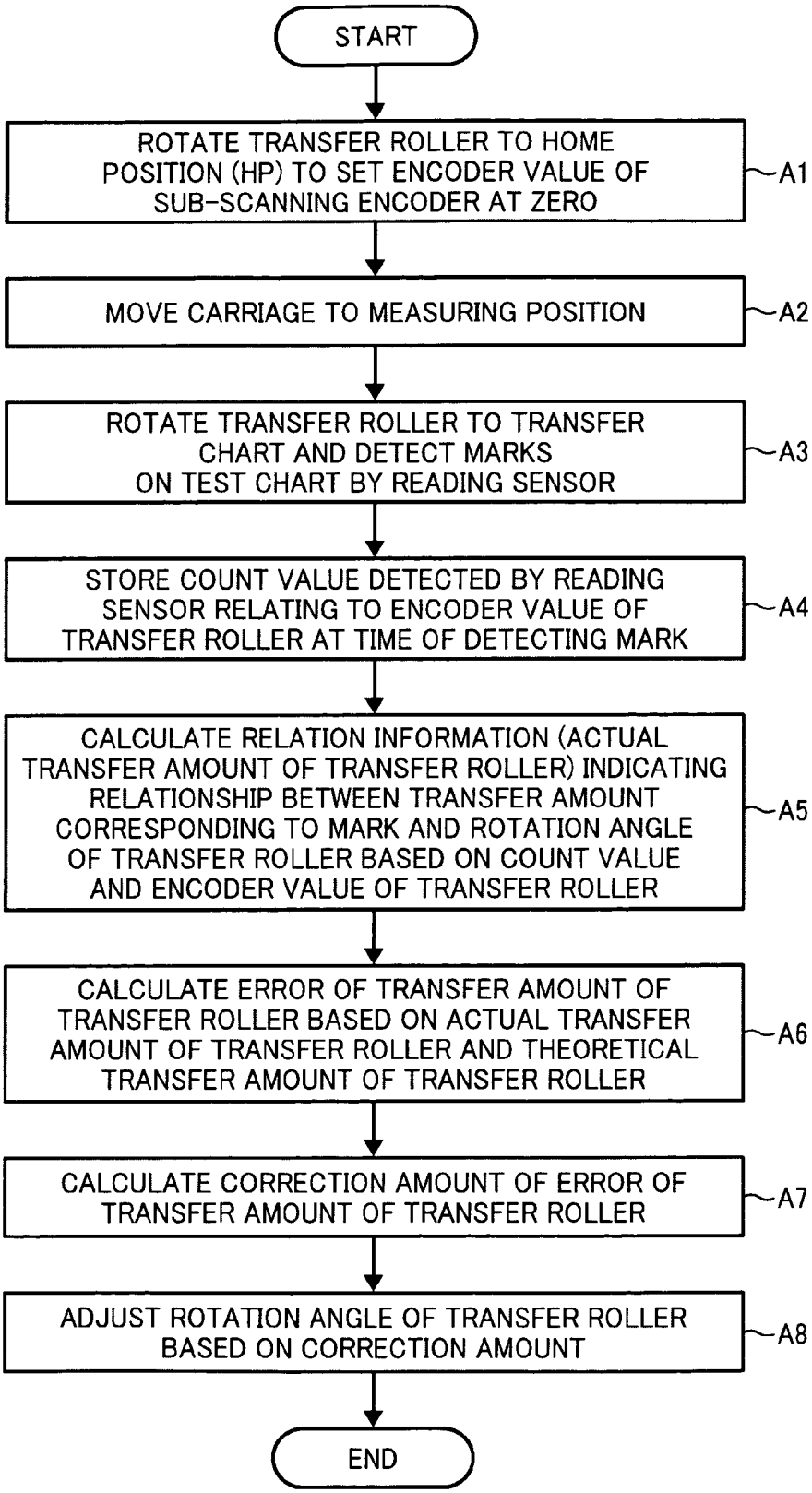
FIG. 9 is a flow chart illustrating a processing example of the recording device of the first embodiment.

Next, the processing operation of the recording device of this embodiment is described next in detail with reference to FIG. 9. FIG. 9 is a flow chart illustrating the processing operation of adjustment on the transfer amount by the transfer roller 15.

The transfer roller 15 is rotated to a home position (HP) and the encoder value of the sub-scanning encoder 32 is set to 0 (step A1). The home position is the reference point of the one cycle of the transfer roller 15 and the home position thereof can be confirmed by the reference mark of the sub-scanning encoder 32.

Then, the carriage 5 is moved to the measuring point (step A2). The measuring point is any point where the transfer amount by the transfer roller 15 is measured in the moving direction of the carriage 5.

Next, the transfer roller 15 is rotated to transfer the printed test chart 100 illustrated in FIG. 6 and the mark 101 arranged thereon is detected by the reading sensor 30 (step A3).

Figure 10A:
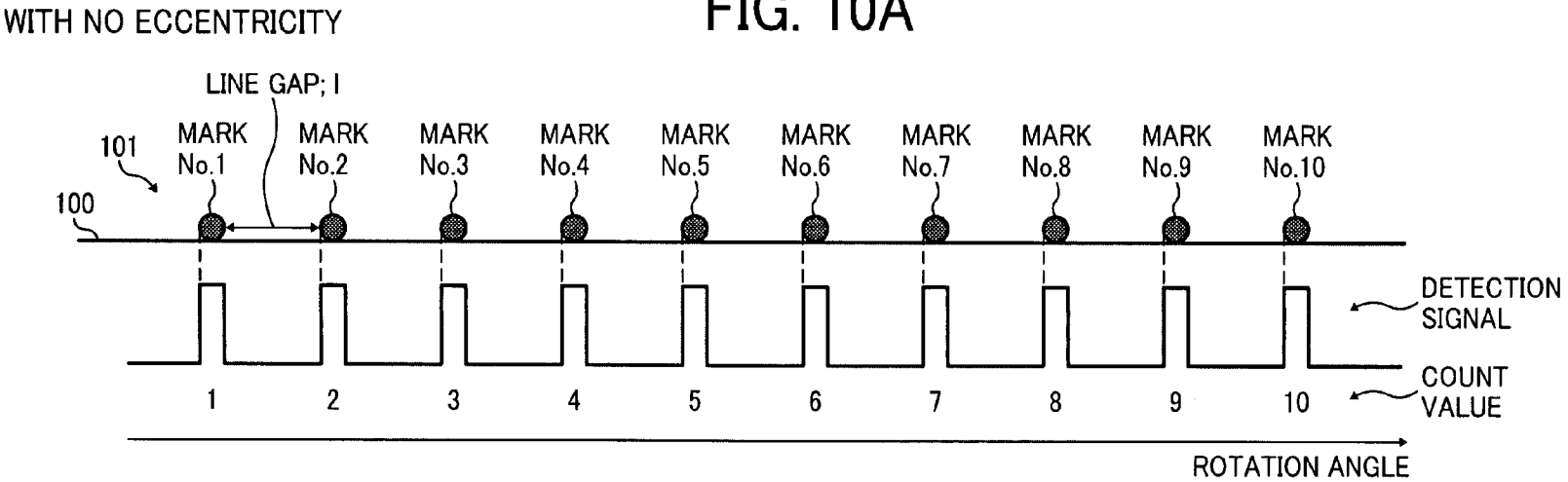
FIG. 10 is a diagram illustrating an example of the detection signals obtained when a mark 101 arranged on a printed test chart 100 is detected by the reading sensor 30.
Figure 10B:
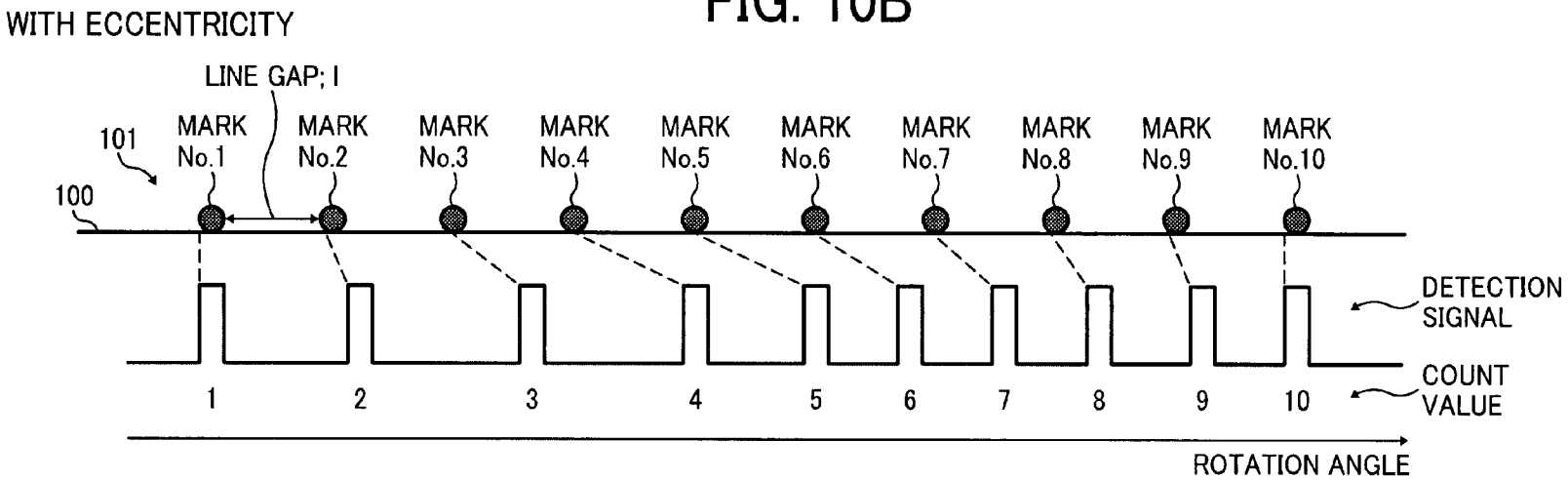

When the mark 101 arranged on the printed test chart 100 illustrated in FIG. 6 is detected by the reading sensor 30, the reading sensor 30 obtains detection signals as illustrated in FIG. 10A or 10B. The FPGA 43 adds the count value every time the reading sensor 30 detects the mark 101. The detection signals illustrated in FIG. 10A have no eccentricity and are thus obtained when the transfer amount by the transfer roller 15 has no variation difference.

When the transfer roller 15 has no eccentricity, the transfer amount has no variation. Therefore, as illustrated in FIG. 10A, the detection signals having the same gap are obtained.

In addition, the detection signals illustrated in FIG. 10B are obtained when the transfer amount by the transfer roller 15 has variation due to the eccentricity thereof.

When the transfer roller 15 has eccentricity, the transfer amount by the transfer roller 15 has variation. Therefore, as illustrated in FIG. 10B, no detection signals having the same gap are obtained.

When the reading sensor 30 detects the mark 101, the CPU 40 reads the count value of the mark 101 from the FPGA 43 and in addition the encoder value from the DSP47, and saves the encoder value in the flash memory 41 (Step A4).

Therefore, the correspondence table illustrated in FIG. 11 can be administered by the flash memory.

The correspondence table illustrated in FIG. 11 is structured to have the count values and the encoder values related to each other. When the reading sensor 30 detects the first mark 101, the CPU 40 reads the count value of 1 from the RAM 430 of the FPGA 43 and at the same time the encoder value of alpha counted by the DSP 47 therefrom, and saves the encoder value in the flash memory 41. Similarly, when the reading sensor 30 detects the second mark 101, the CPU 40 reads the count value of 2 from the RAM 430 of the FPGA 43 and at the same time the encoder value of beta counted by the DSP 47 therefrom, and saves the encoder value in the flash memory 41.

Next, the CPU 40 calculates the relationship information indicating the relationship between the transfer amount corresponding to a desired mark 101 and the rotation angle (rotation position) of the rotation roller 15 at the time when the desired mark 101 is detected based on the information in the correspondence table illustrated in FIG. 11 stored in the flash memory 41 (step A5).

Since the CPU 40 already recognizes the line gap "1" between the marks 101 arranged on the printed test chart 100, the transfer amount corresponding to the desired mark 101 can be obtained by multiplying the count value of the mark 101 by the line gap "1".

For example, when the count value of the mark 101 is 3, the transfer amount at the time is 3×"1".

Furthermore, the CPU 40 calculates the rotation angle (rotation position) of the transfer roller 15 based on the encoder value obtained from the sub-scanning encoder 32. For example, when the transfer roller 15 rotates once, the sub-scanning encoder 32 is assumed to count 38,400. In this case, FPGA 43 calculates the rotation angle B by the calculation of (A/38, 400)×360 degree based on the encoder value A obtained from the sub-scanning encoder 32. Therefore, the CPU 40 administrates the correspondence table illustrated in FIG. 12 by the flash memory 41 to obtain the actual transfer amount by the transfer roller 15. The calculation result of the actual transfer amount by the transfer roller 15 is shown as the graph (b) in FIG. 13A.

Figure 13A:
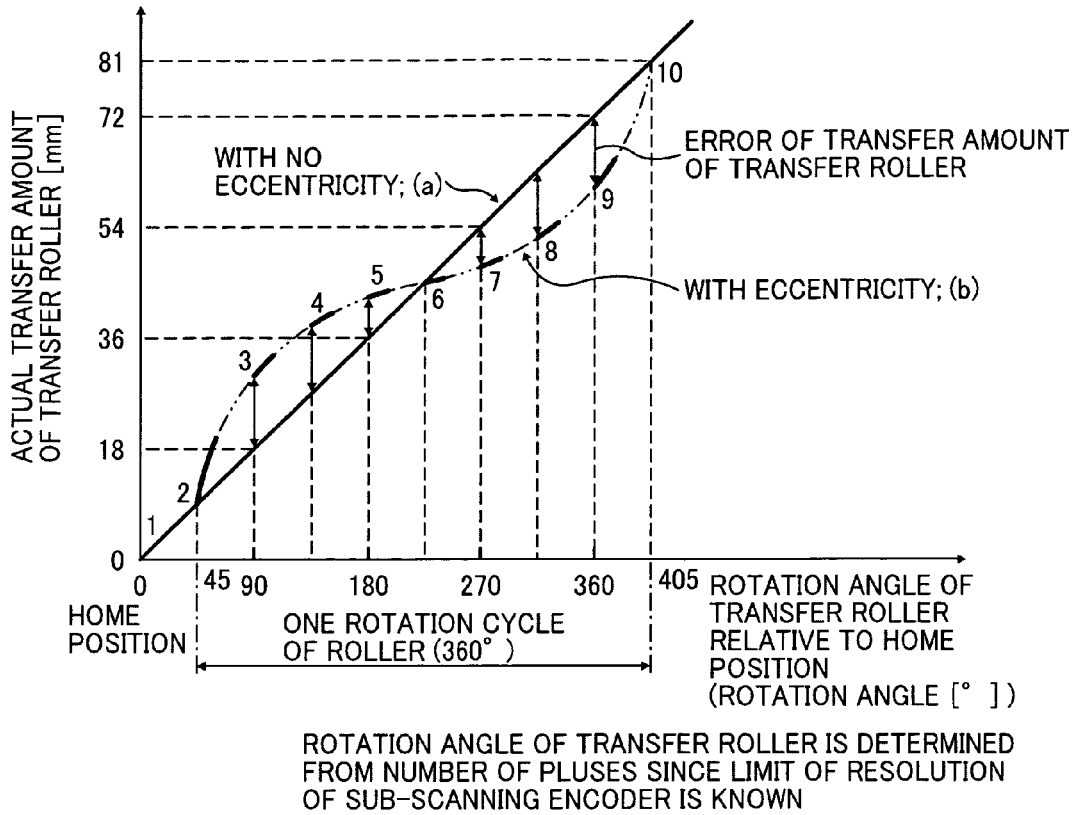
FIG. 13 is graphs illustrating a calculation method for difference in the transfer amount by a transfer roller.

The Y axis of the FIG. 13A represents the actual transfer amount by the transfer roller 15 and the X axis represents the rotation angle (transfer angle) of the transfer roller 15. The transfer amount illustrated in FIG. 12 corresponds to the Y axis of the graph of FIG. 13A and the rotation angle of the transfer roller 15 illustrated in FIG. 12 corresponds to the X axis of the graph of FIG. 13A.

Figure 13B:
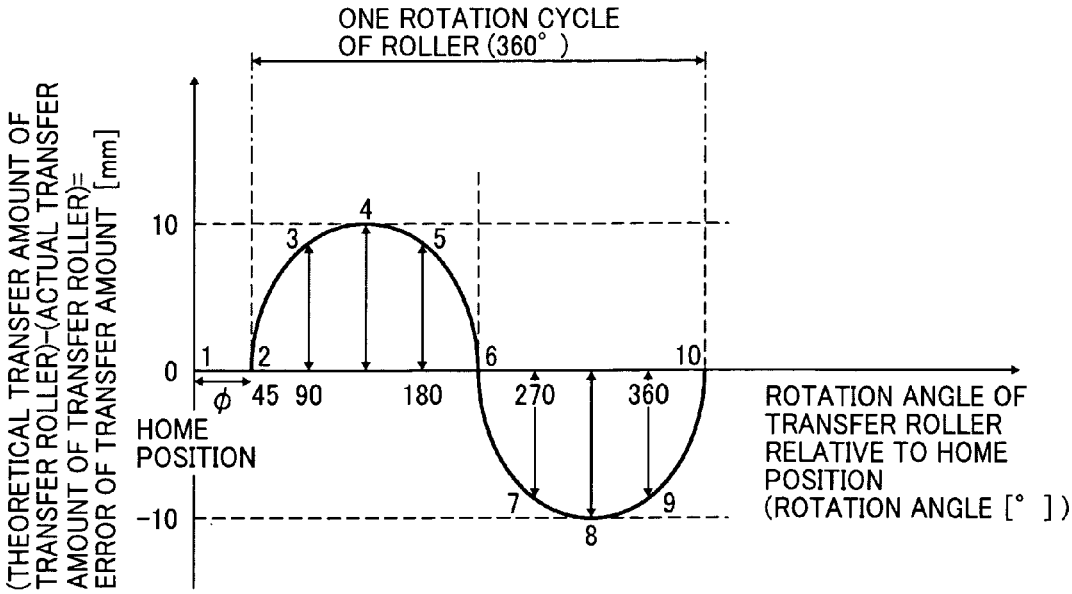

Next, the CPU 40 calculates the difference of the transfer amount by the transfer roller 15 illustrated in FIG. 13B (Step A6).

The CPU 40 already recognizes the line gap "1" between the marks 101 arranged on the printed test chart 100 and also the transfer amount (ideal transfer amount by the transfer roller 15) in the case of no eccentricity.

Therefore, the CPU 40 can calculate the difference of the transfer amount by the transfer roller 15 according to the following relationship (1): The ideal (predetermined theoretical) transfer amount by the transfer roller 15 is represented by the graph (a) illustrated in FIG. 13A.

Error of transfer amount by transfer roller=−(ideal transfer amount by transfer roller)−(actual transfer amount of transfer roller) Relationship (1)

The CPU 40 obtains the relationship shown in FIG. 13B by the calculation of the difference of the transfer amount by the transfer roller 15 using the relationship (1).

As illustrated in FIG. 13B, when the rotation angle of the transfer roller 15 having an difference of the transfer amount of 0 from the home position is defined as the eccentricity phase of phi as illustrated in FIG. 13B and the maximum amplitude value of the difference of the transfer amount is set as the amplitude "A" of a sin curve approximation, the difference of the transfer amount by the transfer roller 15 is represented by the following relationship (2):

Error of transfer amount=10×sin(theta−phi) Relationship (2)

Therefore, the relationship of the difference of the transfer amount illustrated in FIG. 13B is represented by the following relationship (3):

Error of transfer amount=10×sin(theta−45 degree) Relationship (3)

Therefore, the CPU 40 can obtain the difference of the transfer amount by the transfer roller 15.

Next, the CPU 40 calculates the correction amount of the difference of the transfer amount by the transfer roller 15 based on the difference of the transfer amount by the transfer roller 15 as calculated above.

Figure 14:
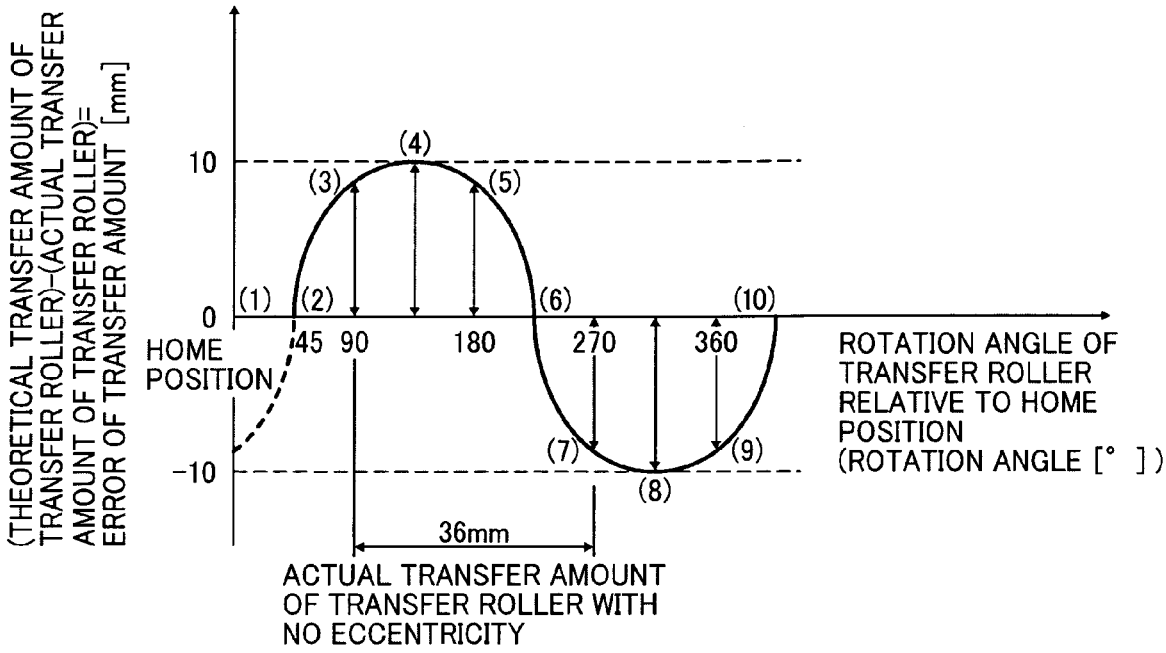
FIG. 14 is a graph illustrating a calculation method for correction amount of difference in the transfer amount by a transfer roller.

For example, as illustrated in FIG. 14, assuming that the current position of the transfer roller 15 is (3), and the transfer roller 15 is rotated until the rotation position of the transfer roller 15 is moved to the target position of the transfer of (7). When the transfer roller 15 has no eccentricity, the transfer amount by the transfer roller 15 is calculated as 36 mm (=54−18) as illustrated in FIG. 13A. However, when the transfer roller 15 has eccentricity, the transfer amount by the transfer roller 15 varies, resulting in the occurrence of the difference of the transfer amount.

Therefore, the CPU 40 calculates the correction amount of the difference of the transfer amount by the transfer roller 15 based on the relationship (3) with regard to the difference of the transfer amount, the information of (3) of the rotation position of the transfer roller 15 before transfer, and the information of (7) of the rotation position of the transfer roller 15 after transfer.

The difference of the transfer amount at the current position of (3) is as follows:

Error of transfer amount=10×sin(90 degree−45 degree)=10×sin 45 degree=10×0.707=7.07 mm.

The difference of transfer amount at the target position of (7) is as follows:

Error of transfer amount=10×sin(270 degree−45 degree)=10×sin 225 degree=10×−0.707=−7.07 mm.

Thus, the correction amount of the difference of the transfer amount is as follows:

Correction amount of difference of transfer amount=(difference of transfer amount of target position)−(difference of transfer amount of current position)=(−7.07−7.07)=−14.14 mm.

The CPU 40 sets a target encoder value in the DSP47 such that the calculated correction amount of the difference of the transfer amount is reflected in the actual transfer amount by the transfer roller 15 and adjusts the rotation angle (transfer angle) of the transfer roller 15 (Step A8). The target encoder value is to make an adjustment such that the transfer amount by the transfer roller 15 reflects the correction amount of the difference of the transfer amount when the rotation angle (transfer angle) of the transfer roller 15 matches the target encoder value.

Thus, the transfer amount reflecting the correction amount of the difference of the transfer amount is as follows:

Transfer amount reflecting correction amount of difference of transfer amount=(transfer amount of transfer roller 15 in the case of no eccentricity)−(Correction amount of difference of transfer amount)=36−(−14.14)=50.14 mm.

The CPU 40 outputs a target encoder value in the DSP47 such that the actual transfer amount by the transfer roller 15 is 50.14 mm and adjusts the rotation angle (transfer angle) of the transfer roller 15.

Figure 15:
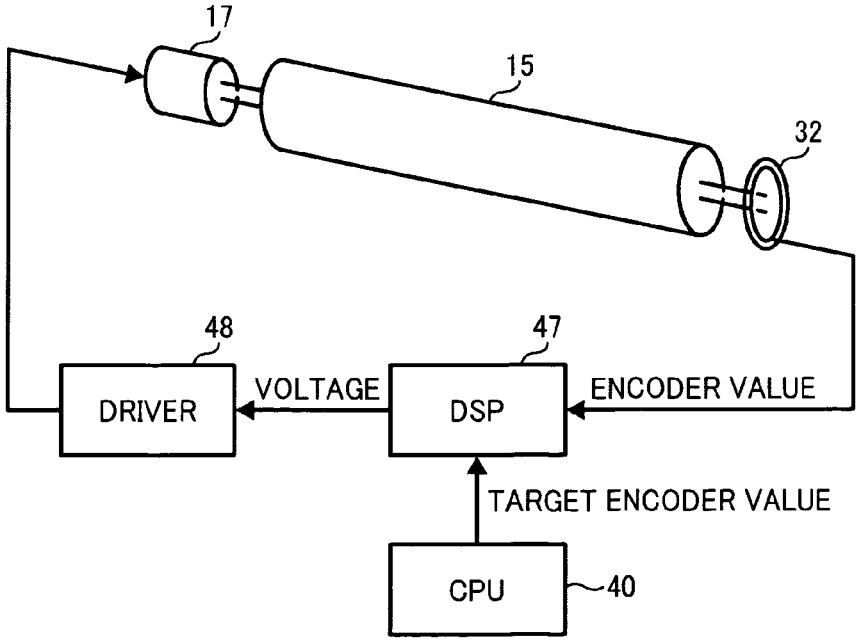
FIG. 15 is a diagram illustrating a processing operation example when the rotation angle of a transfer roller 15 is adjusted.

As illustrated in FIG. 15, the DSP47 adjusts the voltage of a driver 48 based on the target encoder value input by the CPU 40 and the encoder value counted by the DSP 47. For example, the DSP 47 adjusts the voltage of the driver 48 such that the transfer amount by the transfer roller 15 is 50.14 mm when the encoder value obtained from the sub-scanning encoder 32 matches the target encoder value input by the CPU 40.

The driver 48 drives the sub-scanning motor 17 according to the voltage input by the DSP 47, adjusts the rotation angle of the transfer roller 15, and controls the transfer amount per unit of time by the transfer roller 15 to be constant.

Therefore, the CPU 40 calculates the correction amount of the difference of the transfer amount by the transfer roller 15 based on the relationship (3) with regard to the difference of the transfer amount, the information of the rotation position of the transfer roller 15 before transfer, and the information of the rotation position of the transfer roller 15 after transfer. The rotation angle of the transfer roller 15 is adjusted according to the correction amount of the calculated correction amount of the difference of the transfer amount and the transfer amount per unit of time by the transfer roller 15 is made to be constant.

The information on the correspondence table illustrated in FIG. 12 is not necessarily pre-set by the CPU 40. It is possible to make the CPU 40 calculate the information at the time of correction.

In addition, although the value of the sub-scanning encoder 32 is input in the DSP 47 in the configuration of this embodiment, the value can be input into the FPGA 43 instead.

As described above, the recording device of the embodiment rotates the transfer roller 15, and detects the mark 101 arranged on the printed test chart 100 illustrated in FIG. 6. The recording device makes a correspondence table illustrated in FIG. 12 that shows the relationship between the transfer amount for a desired mark 101 and the rotation angle (rotation position) at the time of detecting the desired mark 101 based on the count value of the mark 101 detected by the reading sensor 30 and the encoder value of the transfer roller 15 at the time of detecting the mark 101. The recording device calculates the difference of the transfer amount by the transfer roller 15 based on the correspondence table illustrated in FIG. 12 and the correction amount based on this difference. According to the correction amount, the rotation angle of the transfer roller 15 is adjusted.

Therefore, the recording device of the embodiment can make the transfer amount per unit of time by the transfer roller 15 to be constant by reducing the variation in the transfer amount by the transfer roller 15 in the sub-scanning direction even when problems such as nozzle omission and nozzle bend occur. In addition, the printed test chart 100 is repeatedly used.

Second Embodiment

The second embodiment is described next.

In the first embodiment, the printed test chart 100 is set on the platen board 31 followed by the processing illustrated in FIG. 9 to control the transfer amount per unit of time by the transfer roller 15 to be constant.

In the second embodiment, by transferring the printed test chart 100 while overlapped atop the recording medium 16 on which an actual image is recorded, the transfer amount per unit of time by the transfer roller 15 is controlled to be constant.

If the printed test chart 100 is pinched on the upstream side of the transfer roller 15 and then transferred, the transfer amount varies because a warm gear and a warm wheel are shaky.

However, since the recording medium 16 on which an actual image is recorded receives backward tension, the shaky gear and wheel do not vary the transfer amount.

Therefore, the printed test chart 100 is transferred in a manner close to the actual transfer state in which the printed test chart 100 is being overlapped atop the recording medium 16 on which an actual image is recorded and thus the transfer amount per unit of time by the transfer roller 15 can be controlled to be constant.

The recording device of the second embodiment is described below in detail with accompanying drawings.

Figure 16:
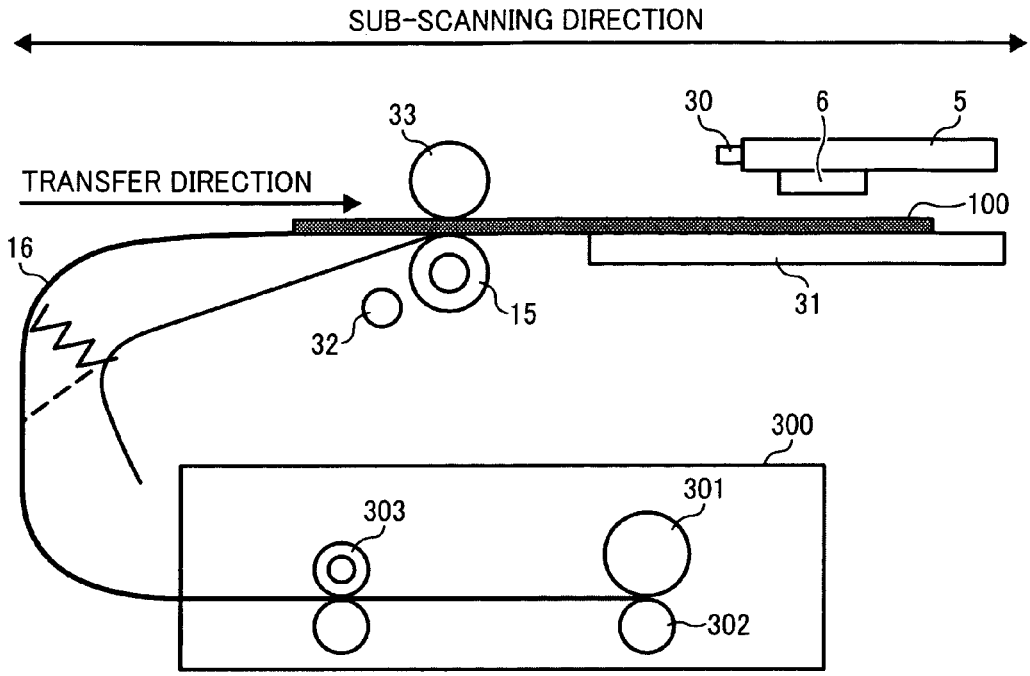
FIG. 16 is a diagram illustrating a schematic structure example of the mechanism of the recording device according to the second embodiment, which is described later.

Structure Example of Recording Device for Use in Detection of Marks Arranged on Test Chart A structure example of the mechanism of the recording device for use in detection of marks 101 arranged on the printed test chart is described next with reference to FIG. 16.

The recording device of this embodiment is structured to have a (first) paper feeder tray 300 that accommodates the recording medium 16. The structure and the control of the paper feeder tray 300 are known and thus descriptions of specific mechanism and control process thereof are omitted.

The recording device of the second embodiment transfers the recording medium 16 wound around a roll 301 by a paper feeding clutch 303, a transfer roller 15, etc. to the platen board 31.

Then, the printed test chart 100 is overlapped on the recording medium 16 transferred onto the platen board 31 and transferred in the sub-scanning direction by the transfer roller 15 followed by detection of the mark 101 arranged on the printed test chart 100 by the reading sensor 30. Then, the transfer amount of the printed test chart 100 is calculated according to the detection signal detected by the reading sensor 30. Furthermore, the encoder value of the transfer roller 15 obtained when the reading sensor 30 detects the mark 101 is acquired from the DSP 47 and the rotation angle of the transfer roller 15 is calculated based on the encoder value.

Figure 17:
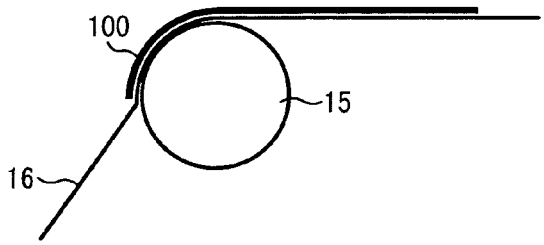
FIG. 17 is diagram illustrating the status in which a recording medium 16 and a printed test chart 100 are transferred wound around part of a transfer roller 15.
Figure 18:
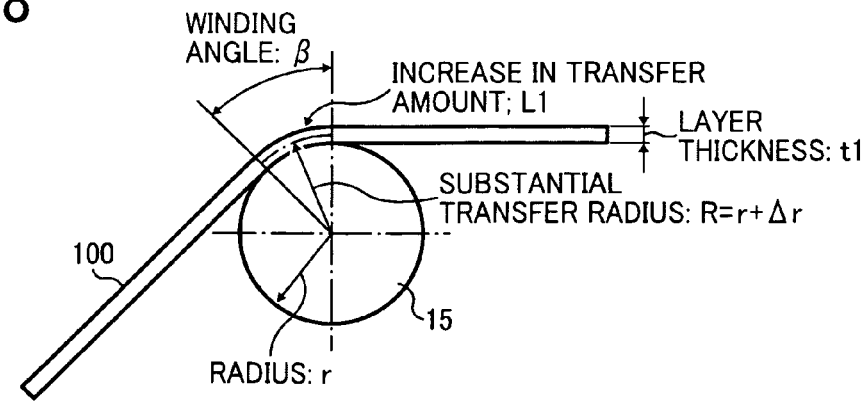
FIG. 18 is diagrams illustrating an increase in the transfer amount.

Since the recording medium 16 in this embodiment receives backward tension, the recording medium 16 and the printed test chart 100 are transferred with part of them wound around the transfer roller 15 as illustrated in FIG. 17. When the recording medium 16 and the printed test chart 100 are transferred with part of them wound around the transfer roller 15, the substantial feeding radius R is represented by the following relationship: R=r+delta r as illustrated in FIG. 18. r represents the radius of the transfer roller 15 and delta r represents an difference of the rotation (transfer) radius and is calculated by the following relationship: delta r=(t1+t2)/2 pi×beta. Delta r (difference of the rotation radius) increases as the layer thickness t1 of the printed test chart 100, the layer thickness t2 of the recording medium, and the winding angle beta increase.

When the recording medium 16 and the printed test chart 100 are transferred with part of them wound around the transfer roller 15, the transfer amount (actual transfer amount by the transfer roller 15) of the printed test chart in the second embodiment is an amount of "L" longer than that of the first embodiment. The increase "L" in the transfer amount of the printed test chart 100 is calculated by the following relationship (4): Lt represents the target transfer amount and corresponds to the transfer amount indicated by the Y axis illustrated in FIG. 13A.

$$L=(t1+t2)\times beta\times Lt/(2pi\times r) \quad \text{Relationship (4)}$$

For example, the increase L in the transfer amount of the printed test chart 100 corresponding to a transfer amount by the transfer roller 15 of 50 mm is calculated as follows: L=(t1+t2)×beta×50/(2 pi×r).

Figure 19:
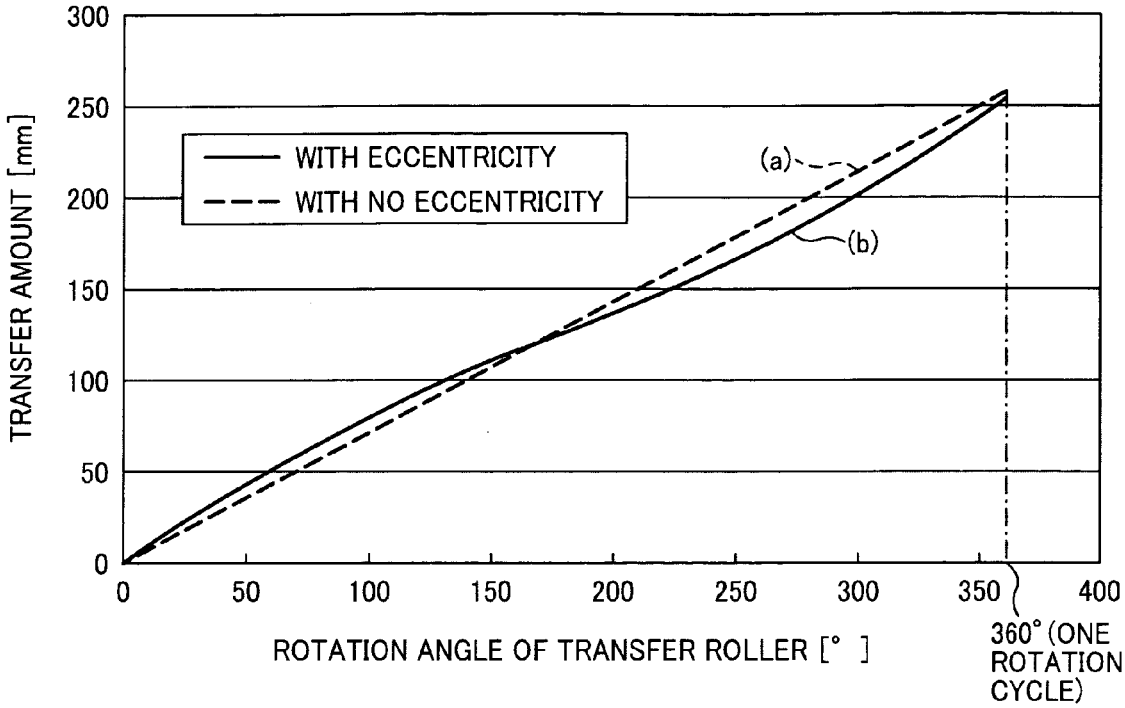
FIG. 19 is a graph illustrating the values used when the rotation angle of the transfer roller is adjusted.

The recording device of the embodiment corrects the actual transfer amount Lt by the transfer roller 15 based on the calculated increase amount L in the transfer amount of the printed test chart 100. For example, assuming that the actual transfer amount by the transfer roller 15 obtained in the first embodiment matches the graph (b) in FIG. 19. The graph (b) in FIG. 19 represents the transfer amount by the transfer roller 15 in the case of eccentricity. The graph (a) in FIG. 19 represents the transfer amount by the transfer roller 15 with no eccentricity. In this case, in the recording device in this embodiment, the increase amount L{=(t1+t2)×beta×50/(2 pi×r)} in the transfer amount as calculated above is subtracted from the actual transfer amount (e.g., 50 mm) of the transfer roller 15 illustrated in FIG. 19(*b*).

Therefore, a desired transfer distance Lt of the graph (b) illustrated in FIG. 19 can be corrected based on the increase amount L in the transfer amount of the printed test chart 100. The transfer amount by the transfer roller 15 illustrated as the graph (b) of FIG. 19 is corrected based on the increase amount L in the transfer amount of the printed test chart 100 and the corrected values are illustrated graphs in FIG. 20.

Figure 20:
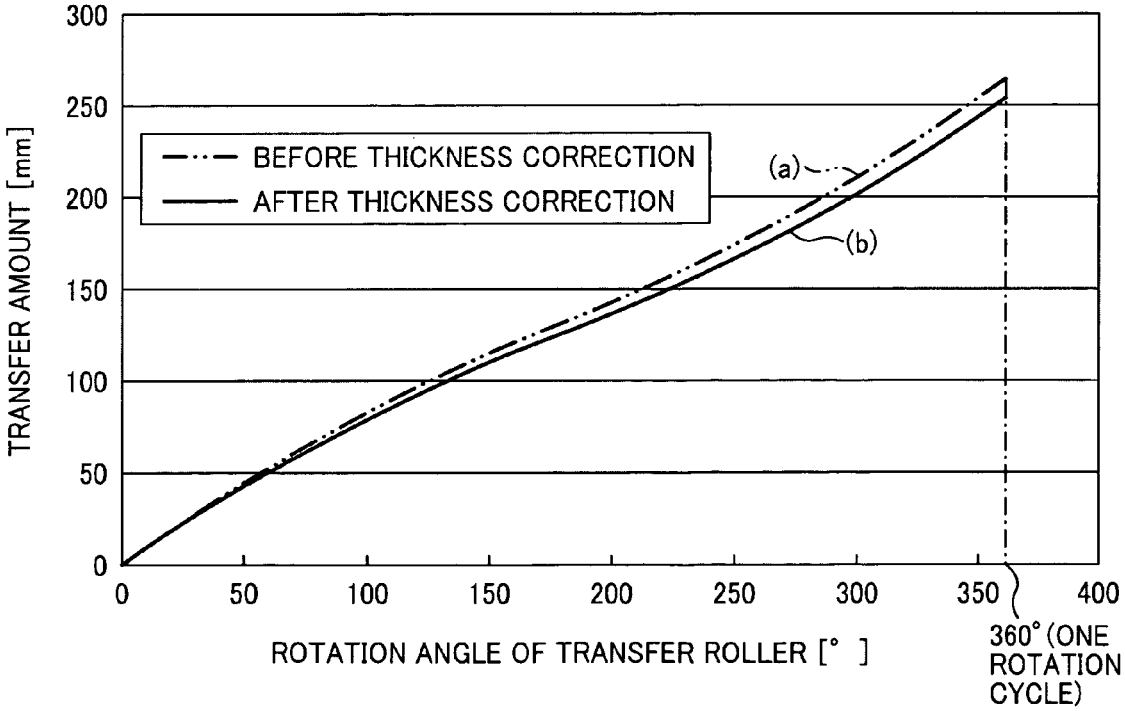
FIG. 20 is a graph illustrating correction of the values (before correction with regard to thickness) of the graph (b) of FIG. 19 representing the case of eccentricity into the values (after correction with regard to thickness) corrected according to the layer thickness difference between the layer thickness of the printed test chart 100 and that of the recording medium 16 on which an actual image is recorded.

The values of the graph (a) in FIG. 20 represent the values of the graph (b) with eccentricity in FIG. 19 (before correction with regard to thickness). The values of the graph (b) in FIG. 20 represent the values of the graph (a) in FIG. 19, which is corrected according to the increase amount of L of the printed test chart 100 (after correction with regard to thickness).

The rotation angle of the transfer roller 15 is adjusted using the graph (b) in FIG. 20 to make the transfer amount per unit of time by the transfer, roller 15 to be constant. Therefore, the transfer amount of the recording medium 16 on which an actual image is recorded can be made to be constant.

As described above, in the second embodiment, by transferring the printed test chart 100 with overlapped atop the recording medium 16 fed from the paper feeder tray 300, the transfer amount per unit of time by the transfer roller 15 is controlled to be constant. The recording medium 16 fed from the paper feeder tray 300 receives backward tension so that the printed test chart 100 does not shift. Therefore, the printed test chart 100 is transferred in a manner close to the actual transfer state and thus the transfer amount per unit of time by the transfer roller 15 can be controlled to be constant in the recording device of the second embodiment.

In addition, the recording device of the second embodiment corrects a desired transfer distance Lt according to the layer thickness t1 of the printed test chart. Therefore, the transfer amount of the recording medium on which an actual image is recorded can be controlled to be constant.

Third Embodiment

The third embodiment is described next.

In the first embodiment, the printed test chart 100 is manually set on the platen board 31 and then transferred in the sub-scanning direction by the transfer roller 15 followed by the processing illustrated in FIG. 9 to control the transfer amount per unit of time by the transfer roller 15 to be constant.

Figure 21:
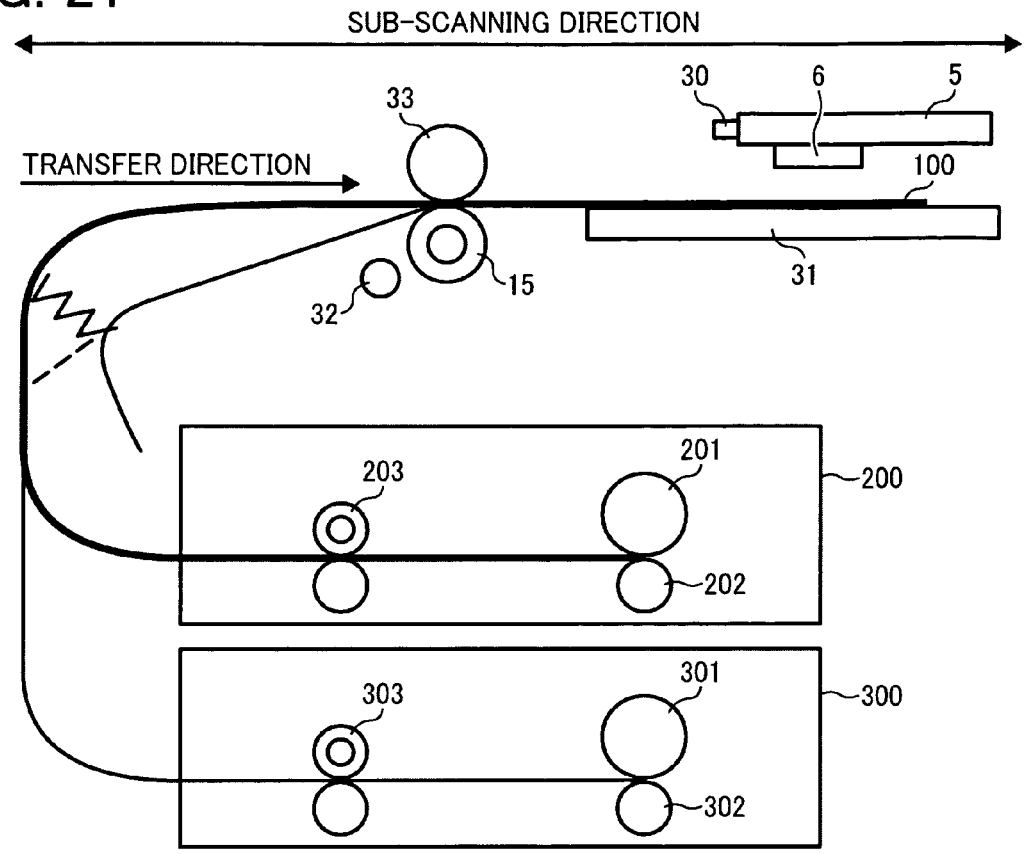
FIG. 21 is a diagram illustrating a schematic structure example of the mechanism of the recording device of the third embodiment, which is described later.

As illustrated in FIG. 21, the third embodiment is structured to have a (second) paper feeder tray 200 that accommodates the printed test chart 100 and automatically transfer the printed test chart 100 in the paper feeder tray 200 to the platen board 31 via a paper feeding clutch 203, the transfer roller 15, etc.

The printed test chart 100 is transferred in the sub-scanning direction by the transfer roller 15 followed by the processing illustrated in FIG. 9 to control the transfer amount per unit of time by the transfer roller 15 to be constant. Therefore, the printed test chart 100 can be automatically transferred to the platen board 31 without setting the printed test chart 100 on the platen 31 manually and subject to the processing illustrated in FIG. 9.

The recording device of the third embodiment is described below in detail with accompanying drawings.

Structure Example of Recording Device for Use in Detection of Marks Arranged on Test Chart A structure example of the mechanism of the recording device for use in detection of the mark 101 arranged on the printed test chart 100 is described next with reference to FIG. 21.

The recording device of this embodiment is structured to have the paper feeder tray 200 that exclusively accommodates the printed test chart 100, and the paper feeder tray 300 that accommodates the recording medium 16 on which an actual image is recorded.

The paper feeder tray 200 is structured to have a roll 201 around which the printed test chart 100 is wound, a rewinding clutch 202, and a paper feeding clutch 203.

The rewinding clutch 202 rewinds the printed test chart 100 on the roll 201. The paper feeding clutch 203 transfers the printed test chart 100 wound around the roll 201 to the side of the transfer roller 15.

The paper feeder tray 300 is structured to have a roll 301 around which the printed test chart 16 is wound, a rewinding clutch 302, and a paper feeding clutch 303. The rewinding clutch 302 rewinds the recording medium 16 onto the roll 301. The paper feeding clutch 303 transfers the recording medium 16 wound around the roll 301 to the side of the transfer roller 15. The structure and the control of the paper feeder tray 300 are known and thus descriptions of specific mechanism and control process thereof are omitted. The structure and the control of the paper feeder tray 200 are almost the same as the paper feeder tray 300 and thus descriptions of specific mechanism and control process thereof are also omitted.

In the recording device of this embodiment, a start button is provided to start the processing illustrated in FIG. 9 and when the button is pressed, the paper feeder tray 300 is switched to the paper feeder tray 200.

The printed test chart 100 wound round the roll 201 is transferred to the platen board 31 via the paper feeding clutch 201, the transfer roller 15, etc. followed by the processing illustrated in FIG. 9. Therefore, the printed test chart 100 is automatically transferred to the platen board 31 and subject to the processing illustrated in FIG. 9.

The printed test chart 100 fed from the paper feeder tray 200 receives backward tension so that the printed test chart 100 does not shift. Therefore, the printed test chart 100 is transferred in a manner close to the actual transfer state and thus the transfer amount per unit of time by the transfer roller 15 can be controlled to be constant in the recording device of the third embodiment.

When the processing illustrated in FIG. 9 is complete, the printed test chart 100 transferred to the platen board 31 is transferred back to and rewound around the roll 201 via the transfer roller 15, the rewinding clutch 202, etc. Then, the paper feeder tray 200 is switched to the paper feeder tray 300 and an image is recorded on the recording medium 16 that is accommodated in the paper feeder tray 300. Therefore, the printed test chart 100 is used in a repeating manner, which contributes to an effective use of the resource.

In the processing described above, when the start button is pressed, the printed test chart 100 is transferred to the platen board 31 and then the processing illustrated in FIG. 9 starts. Also, the processing illustrated in FIG. 9 can be set to start upon power-on of the recording device or a change of the environment of the recording device.

The change of the environment can be recognized by, for example, using a method of detecting the time when a temperature change measured by a temperature sensor in the recording device surpasses a predetermined threshold.

Since the printed test chart 100 fed from the paper feeder tray 200 receives backward tension, the printed test chart 100 is transferred with part of it wound around the transfer roller 15 as illustrated in FIG. 17. When the printed test chart 100 is transferred with part of them wound around the transfer roller 15, the substantial feeding radius R is represented by the following relationship: R=r+delta r as illustrated in FIG. 18. r represents the radius of the transfer roller 15 and delta r represents an difference of the rotation (transfer) radius and calculated by the following relationship: delta r=(t1/2 pi)× beta. delta r (difference of the transfer radius) increases in proportion to the layer thickness t1 of the printed test chart 100, and the winding angle beta. The winding angle beta occurs when a mechanism (tension guide board) that absorbs the slack of the recording medium 16 functions during a transfer of the recording medium 16. The winding angle beta is from about 10 degree to 40 degree.

When the printed test chart 100 is transferred with part of it wound around the transfer roller 15, the transfer amount of the printed test chart 100 in the third embodiment is an amount of "L1" longer than that of the first embodiment. The increase amount "L1" in the transfer amount of the printed test chart 100 is calculated by the following relationship (5): Lt represents the target transfer amount and corresponds to the transfer amount indicated by the Y axis illustrated in FIG. 13A.

$$L = t1 \times \text{beta} \times Lt/(2\text{pi} \times r) \qquad \text{Relationship (5)}$$

For example, the increase amount L in the transfer amount of the printed test chart 100 corresponding to a transfer amount by the transfer roller 15 of 50 mm is calculated as follows: L=t1×beta×50/(2 pi×r).

When the layer thickness t1 of the printed test chart 100 is different from the layer thickness t2 of the recording medium 16 on which an actual image is recorded, the increase L1 in the transfer amount of the printed test chart 100 is different from the increase L2 in the transfer amount of the recording medium 16. The increase L2 in the transfer amount of the recording medium 16 is calculated by the following relationship (6):

$$L = t2 \times \text{beta} \times Lt/(2\text{pi} \times r) \qquad \text{Relationship (6)}$$

Therefore, when the processing illustrated in FIG. 9 using the printed test chart 100 is performed and the transfer amount per unit of time by the transfer roller 15 is controlled to be constant, and an image is recorded on the recording medium 16 having a thickness of t2 which is different from the thickness t1 of the printed test chart 100, a transfer deviation of {|t1−t21|×beta×Lt/(2 pi×r)} occurs according to the difference |t1−t2| of the layer thickness t1 of the printed test chart 100 and the layer thickness t2 of the recording medium 16.

Therefore, the recording device of this embodiment corrects the desired transfer distance Lt of the actual transfer amount by the transfer roller 15 according to the difference |t1−t2| of the layer thickness t1 of the printed test chart 100 and the layer thickness t2 of the recording medium 16. Therefore, the transfer amount of the recording medium 16 is controlled to be constant when the layer thickness t2 of the recording medium 16 is different from the thickness t1 of the printed test chart 100.

When the layer thickness t1 of the printed test chart 100 is thicker than the layer thickness t2 of the recording medium 16 (i.e., t1>t2), the distance delta L{=|t1−t2|×beta×Lt/(2 pi×r)} according to the difference |t1−t2| is subtracted from the desired transfer distance (e.g., 50 mm) of the actual transfer amount by the transfer roller 15 (that is, 50 mm—delta L). Therefore, the recording device of this embodiment corrects the desired transfer distance Lt of the actual transfer amount by the transfer roller 15 according to the difference |t1−t2| of the layer thickness t1 of the printed test chart 100 and the layer thickness t2 of the recording medium 16. The values of the graph (b) of FIG. 19 are corrected according to the difference |t1−t2| of the layer thickness t1 of the printed test chart 100 and the layer thickness t2 of the recording medium 16 and FIG. 22 illustrates the graphs reflecting the correction.

Figure 22:
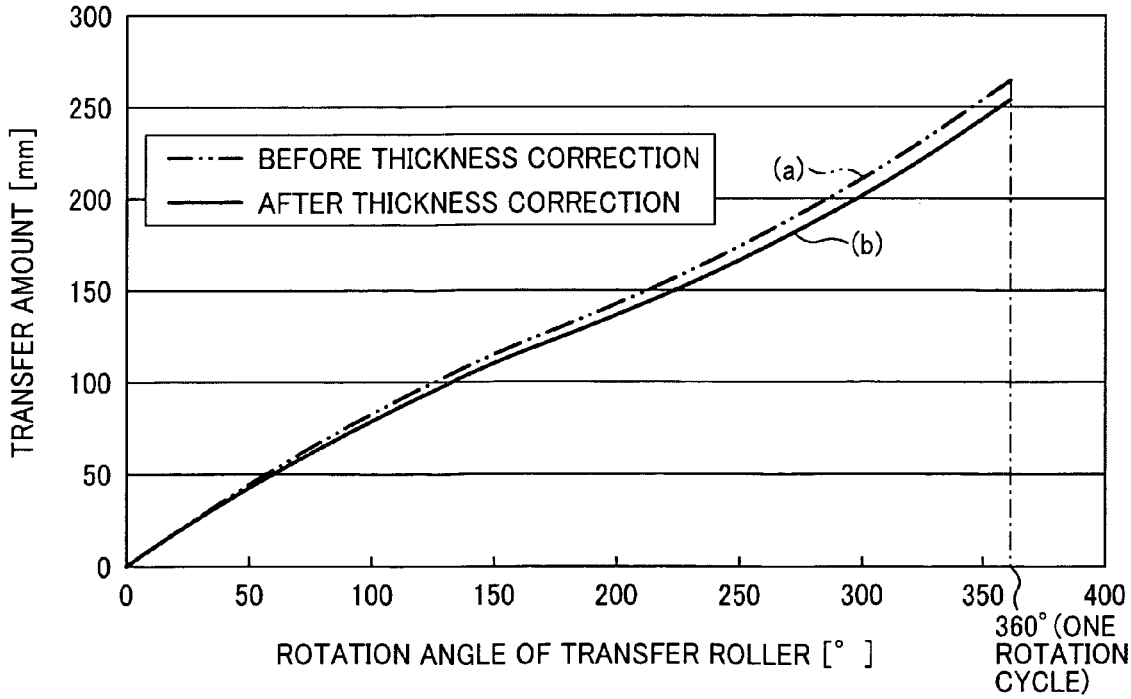
FIG. 22 is a graph illustrating correction of the values (before correction with regard to thickness) of the graph (b) of FIG. 19 representing the case of eccentricity into the values (after correction with regard to thickness) corrected according to the increase in the transfer amount of the printed test chart 100.

The values of the graph (a) of FIG. 22 represent the values of the graph (b) with eccentricity in FIG. 19 (before correction with regard to thickness). The values of the graph (b) in FIG. 22 represent the values of the graph (a) in FIG. 22, which is corrected according to difference |t1−t2| of the layer thickness t1 of the printed test chart 100 and the layer thickness t2 of the recording medium 16 (after correction with regard to thickness). The rotation angle of the transfer roller 15 is adjusted using the values of the graph (b) in FIG. 22 to make the transfer amount per unit of time by the transfer roller 15 to be constant in the recording device of this embodiment. Therefore, the transfer amount of the recording medium 16 is controlled to be constant when the layer thickness t1 of the recording medium 16 is different from the thickness t1 of the printed test chart 100.

The correction method described above is described using an example in which the layer thickness t1 of the printed test chart 100 is thicker than the layer thickness t2 of the recording medium 16 (i.e., t1>t2). When the layer thickness t1 of the printed test chart 100 is thinner than the layer thickness t2 of the recording medium 16 (i.e., t1, t2), the distance delta L {=|t1−t2|×beta×Lt/(2 pi×r)} according to the difference |t1−t2| is added to the desired transfer distance (e.g., 50 mm) (that is, 50 mm+delta L).

As described above, in the recording device of the third embodiment, the transfer amount per unit of time by the transfer roller 15 is controlled to be constant by providing the paper feeder tray 200 that accommodates the printed test chart 100, and automatically transferring the printed test chart 100 stored in the paper feeder tray 200 to the platen board 31 followed by the processing illustrated in FIG. 9. Therefore, the printed test chart 100 can be automatically transferred to the platen board 31 without setting the printed test chart 100 on the platen 31 and subject to the processing illustrated in FIG. 9. The printed test chart 100 fed from the paper feeder tray 200 receives backward tension so that the printed test chart 100 does not shift. Therefore, the printed test chart 100 is transferred in a manner close to the actual transfer state and thus the transfer amount per unit of time by the transfer roller 15 can be controlled to be constant in the recording device of the third embodiment.

In addition, when the layer thickness t1 of the printed test chart 100 and the layer thickness t2 of the recording medium 16 are different from each other, the recording device of this embodiment corrects the desired transfer distance Lt of the actual transfer amount by the transfer roller 15 according to the difference |t1−t2| of the layer thickness t1 of the printed test chart 100 and the layer thickness t2 of the recording medium 16. Therefore, the transfer amount of the recording medium 16 is controlled to be constant when the layer thickness t2 of the recording medium 16 is different from the thickness t1 of the printed test chart 100.

Fourth Embodiment

The fourth embodiment is described next.

The first, second and third embodiments are described assuming that the printed test chart 100 is transferred in a normal state as described in FIG. 23A. However, it is likely that the printed test chart 100 is transferred in a slanted manner with an angle of phi as illustrated in FIG. 23B. The detection signals obtained from the printed test chart 100 that is being transferred with a slanted angle of phi as illustrated in FIG. 23B are different from those obtained from the printed test chart 100 that is being transferred correctly as illustrated in FIG. 23A. Therefore, when the printed test chart 100 is transferred with a slanted angle of phi as illustrated in FIG. 23B, the transfer amount by the transfer roller 15 is uncontrollable and not constant.

The recording device of this embodiment identifies the slant angle of phi when the printed test chart 100 is transferred slanted with an angle of phi as illustrated in FIG. 23B, and corrects the detection signals obtained from the printed test chart 100 illustrated in FIG. 23B to the detection signals obtained from the printed test chart 100 illustrated in FIG. 23A based on the identified slant angle of phi. Therefore, when the printed test chart 100 is transferred slanted with an angle of phi as illustrated in FIG. 23B, the recording device of this embodiment makes correction to the right state illustrated in FIG. 23A, and adjusts the rotation angle of the transfer roller 15 to control the transfer amount by the transfer roller 15 to be constant.

The recording device of the fourth embodiment is described below in detail with accompanying drawings.

Arrows illustrated in FIGS. 23A and 23B indicate the trajectory read by the reading sensor 30 when the printed test chart 100 is transferred correctly or wrongly with an angle of phi slanted from the correct state.

FIG. 23A illustrates the trajectory when the printed test chart 100 is transferred correctly, and FIG. 23B illustrates the trajectory when the printed test chart 100 is transferred with an angle of phi.

When the printed test chart 100 is transferred slanted with an angle of phi as illustrated in FIG. 23B, the gap between the lines (marks) "l" is 1/cos phi wider than in the correct state illustrated in FIG. 23A. Therefore, the number of marks (count value) shown in FIG. 23D counted during one rotation cycle of the transfer roller 15 in the state illustrated in FIG. 23B is smaller than the number of marks (count value) shown FIG. 23C in the correct state illustrated in FIG. 23A.

FIG. 23C represents the detection signals when the printed test chart 100 is correctly transferred as illustrated in FIG. 23A, and FIG. 23D represents the detection signals when the printed test chart 100 is transferred with an angle of phi as illustrated in FIG. 23B.

Thus, the recording device of this embodiment determines that the printed test chart 100 is transferred with an angle of phi as illustrated in FIG. 23B when the number of the marks (count value) counted during one rotation cycle of the transfer roller 15 is smaller than that in the right state illustrated in FIG. 23A, identifies the slant angle of phi, performs skew correction using the identified slant angle, and converts the transfer distance obtained from the state illustrated in FIG. 23B into the transfer distance obtained from the state illustrated in FIG. 23A.

The slant angle of phi is calculated using the following relationship (7).

$$\text{Count difference}=[L_{(}1-\cos \text{phi})/l] \qquad \text{Relationship (7)}$$

Figure 23:
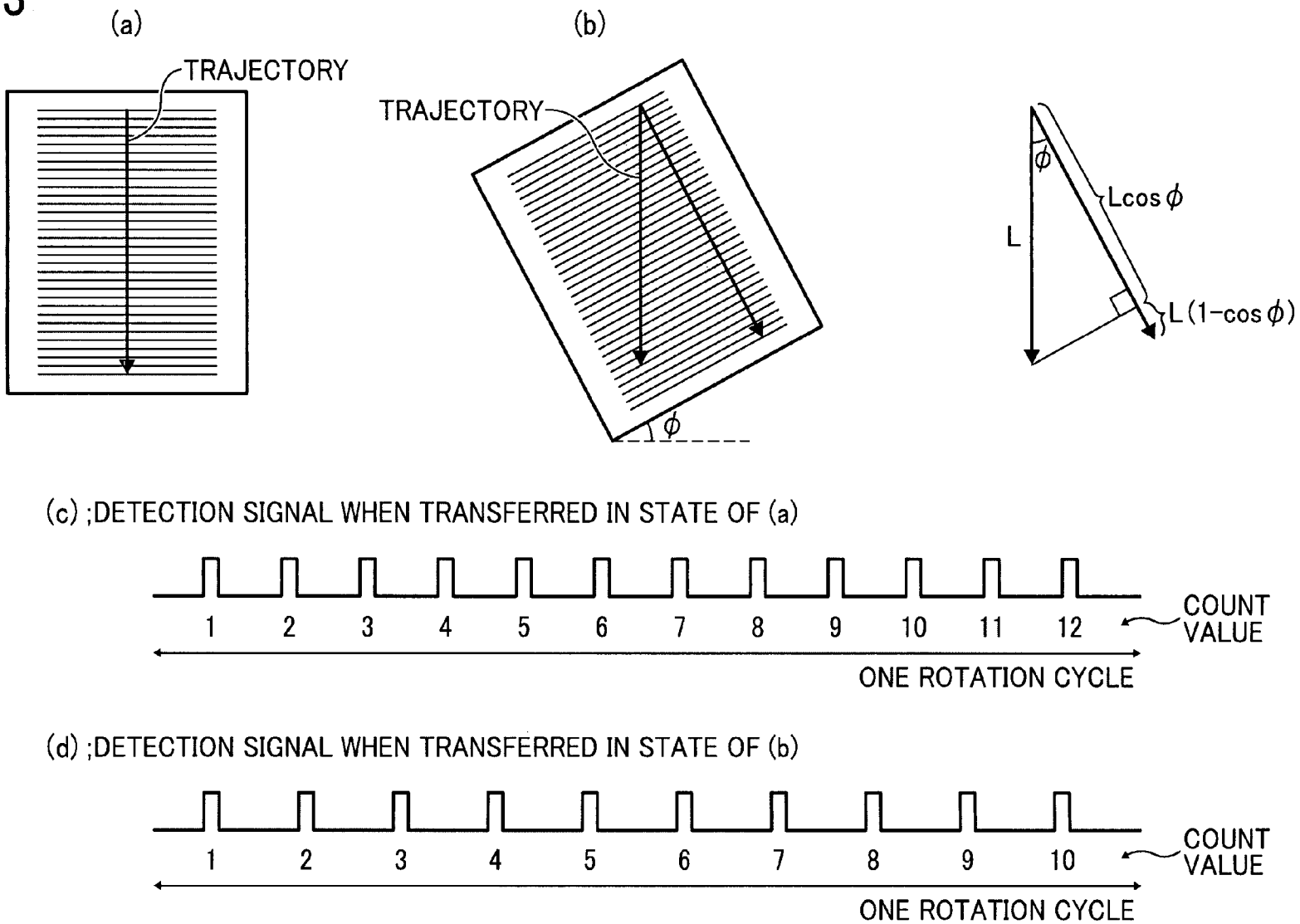
FIG. 23 is a diagram illustrating the state in which the printed test chart 100 is transferred correctly, and the state in which the printed test chart 100 is transferred askew with an angle of phi.

The count difference is the difference between the number of marks (count value) counted in the right state in which the printed test chart 100 is transferred as illustrated in FIG. 23A and the number of marks (count value) counted in the state in which the printed test chart 100 is transferred slanted with an angle of phi as illustrated in FIG. 23B. The count difference is 2 in FIG. 23. In addition, the count value obtained when the transfer roller 15 rotates two or more rotation cycles can be used as the count difference. Furthermore, when a 600 dpi line chart is used as the mark 101, the count value obtained when both black and white are counted can be also used.

These help to improve the accuracy of the count difference.

L represents the transfer distance (right state as illustrated in FIG. 23A) during one cycle of the transfer roller 15.

"l" represents the gap between the lines of the mark 101.

The skew correction is calculated by multiplying the transfer distance L obtained in the state of the slanted angle of phi illustrated in FIG. 23B by 1/cos phi based on the slanted angle phi calculated by using the relationship. Therefore, the transfer distance L obtained in the state illustrated in FIG. 23B can be converted into the transfer distance L×1/cos phi illustrated in FIG. 23A.

Figure 24:
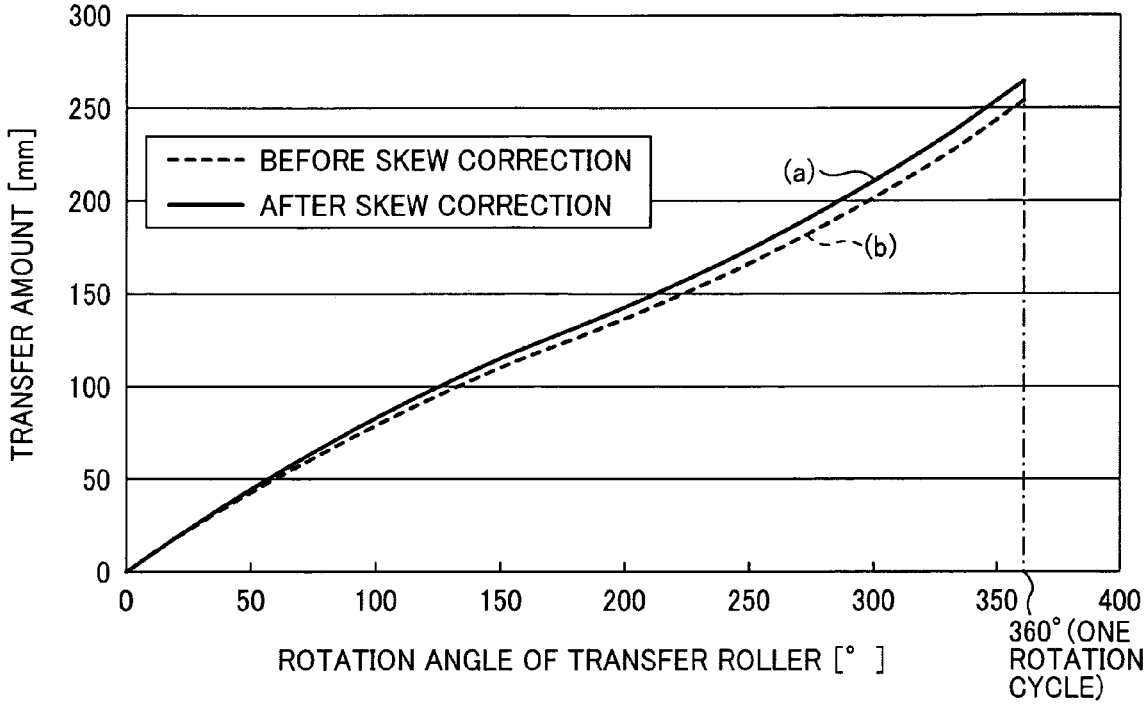
FIG. 24 is a graph illustrating correction of the values (before correction with regard to skew) of the graph (b) of FIG. 19 representing the case of eccentricity into the values (after correction with regard to skew) corrected according to the skew angle of phi.

The value obtained in the state illustrated in FIG. 23B and the value obtained in the state illustrated in FIG. 23A are illustrated in FIG. 24. The graph (b) in FIG. 24 represents the values obtained in the state illustrated in FIG. 23B (i.e., before the skew correction), and the graph (a) in FIG. 24 represents the values obtained in the state illustrated in FIG. 23A (i.e., after the skew correction). The value illustrated in (b) of FIG. 23B is converted into the value illustrated in (b) of FIG. 23A by skew correction. The rotation angle of the transfer roller 15 is adjusted using the value illustrated in FIG. 23A to make the transfer amount per unit of time by the transfer roller 15 to be constant. Therefore, when the printed test chart 100 is transferred slanted with an angle of phi as illustrated in FIG. 23B, the recording device of this embodiment makes correction to the right state illustrated in FIG. 23A, and adjusts the rotation angle of the transfer roller 15 to control the transfer amount by the transfer roller 15 to be constant.

Thus, the recording device of this embodiment determines that the printed test chart 100 is transferred with an angle of phi as illustrated in FIG. 23B when the number of the marks (count value) counted by the reading sensor 30 during one rotation cycle of the transfer roller 15 is smaller than the predetermined number of marks (count value) in the right state illustrated in FIG. 23A, and identifies the slant angle of phi. Then, the recording device performs skew correction using the identified slant angle, and converts the transfer distance obtained from the state illustrated in FIG. 23B into the transfer distance obtained from the state illustrated in FIG. 23A to obtain the graph (a) illustrated in FIG. 24. Then, the rotation angle of the transfer roller 15 is adjusted using the graph (a) illustrated in FIG. 24 to make the transfer amount per unit of time by the transfer roller 15 to be constant. Therefore, when the printed test chart 100 is transferred slanted with an angle of phi as illustrated in FIG. 23B, the recording device of this embodiment makes correction to the right state illustrated in FIG. 23A, and adjusts the rotation angle of the transfer roller 15 to control the transfer amount of the recording medium 16 by the transfer roller 15 to be constant.

The embodiments described above are preferable embodiments of the present invention and do not limit the scope of the present invention.

Figure 25:
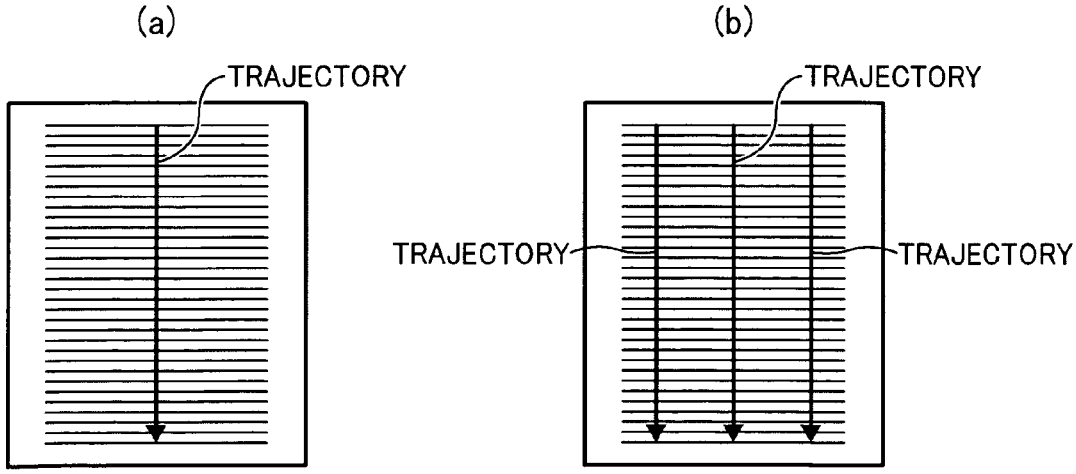
FIG. 25 is a diagram illustrating a method of detecting the mark 101 arranged on the printed test chart 100.

For example, the mark 101 arranged on the printed test chart 100 can be detected only once along the trajectory indicated by the arrow illustrated in FIG. 25A, or multiple times along the trajectory indicated by the arrow illustrated in FIG. 25B. When the mark 101 is detected three times as illustrated in FIG. 25B, the rotation amount of the transfer roller 15 is preferably adjusted by using the average of the correction table obtained from the signals detected three times. Therefore, the rotation amount of the transfer roller 15 is accurately adjusted.

In addition, the printed test chart 100 is not limited to the one having the structure illustrated in FIG. 6. Any arrangement in which a plural of the predetermined marks 101 are arranged can be used. In addition, in FIG. 6, the mark 101 is arranged with the same gap but can be arranged irregularly. However, since the recording device of the present invention calculates the transfer distance (rotation angle) of the transfer roller 15 based on the detection signals (count value) obtained by detecting the mark 101, the recording device is structured to administrate the count value and the transfer distance corresponding to the count value in a memory such as a flash memory 41 while relating to each other and determine the transfer distance of the transfer roller 15 using the information administrated in the memory. To be specific, the recording device is structured to detect the count value from the first value in sequence, and acquire the transfer distance corresponding to the count value from the memory to determine the transfer distance of the transfer roller 15.

In addition, each part constituting the recording device in the embodiments described above can be controlled by using hardware, software or a combination of both.

In the case of software, a program in which the process sequence is recorded is installed in the memory in a computer integrated in exclusive hardware. Alternatively, the program can be installed in a universal computer that performs various kinds of processes.

For example, the program can be preliminarily recorded in a hard disc or read only memory (ROM) functioning as recording media. Alternatively, the program can be temporarily or permanently stored in a removable recording medium. Such removable recording media can be provided as a package software.

Specific examples of such removable recording media include, but are not limited to, a floppy disks, a compact disc read only memory (CD-ROM), a magneto optical (MO) disc, a digital versatile disc (DVD), a magnetic disc, and a semiconductor memory.

The program is installed from the removable media mentioned above to a computer. In addition, the program can be also wireless transferred from a download site. In addition, the program can be also transferred with fixed lines using a network.

The recording device of the embodiments performs the processes described above sequentially. In addition, the recording device can be structured to perform processing in parallel or individually based on the processing power of each device or on a necessity basis.

This document claims priority and contains subject matter related to Japanese Patent Application No. 2009-049926, filed on Mar. 3, 2009, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A recording device, comprising:

a paper feeder tray that accommodated a recording medium;

a print head that discharges ink on the recording medium to record an image thereon;

a transfer roller that transfers the recording medium and a printed test chart on which multiple marks are arranged for adjusting a rotation amount of the transfer roller;

a control device that controls the transfer roller;

a first detection device that detects a rotation position of the transfer roller;

a second detection device that detects the multiple marks arranged on the printed test chart; and a transfer device that transfers the recording medium from the paper feeder tray to the second detection device, wherein the control device obtains a difference between an actual transfer amount of each of the multiple marks obtained by detecting the multiple marks by the second detection device and a set theoretical transfer amount of each of the multiple marks relating to the rotation position of the transfer roller, calculates a correction amount for a rotation amount of the transfer roller based on a relationship between the rotation position of the transfer roller and the difference, and controls the rotation amount of the transfer roller using the correction amount, and wherein, based on the relationship between the rotation position of the transfer roller and the difference, the control device determines a first difference with regard to a current rotation position of the transfer roller and a second difference with regard to a position after rotation of the transfer roller, and calculates the correction amount from a difference between the first difference and the second difference.

2. The recording device according to claim 1, wherein the control device controls the transfer roller such that the rotation amount of the transfer roller matches an actual rotation amount thereof, the actual rotation amount of the transfer roller obtained by subtracting the correction amount from a theoretical rotation amount of the transfer roller between the current rotation position of the transfer roller and the position after rotation.

3. The recording device according to claim 1, wherein the printed test chart is overlapped on the recording medium before the printed test chart is transferred to the second detection device.

4. The recording device according to claim 3, wherein the control device corrects the actual transfer amount of each of the multiple marks according to a layer thickness of the printed test chart.

5. A recording device, comprising:

a first paper feeder tray that accommodated a recording medium;

a print head that discharges ink on the recording medium to record an image thereon;

a transfer roller that transfers the recording medium and a printed test chart on which multiple marks are arranged for adjusting a rotation amount of the transfer roller;

a control device that controls the transfer roller;

a first detection device that detects a rotation position of the transfer roller;

a second detection device that detects the multiple marks arranged on the printed test chart;

a first transfer device that transfers the recording medium from the first paper feeder tray to the second detection device;

a second paper feeder tray that accommodates the printed test chart, and a second transfer device that transfers the printed test chart accommodated in the second paper feeder tray to the second detection device, wherein the control device obtains a difference between an actual transfer amount of each of the multiple marks obtained by detecting the multiple marks by the second detection device and a set theoretical transfer amount of each of the multiple marks relating to the rotation position of the transfer roller, calculates a correction amount for a rotation amount of the transfer roller based on a relationship between the rotation position of the transfer roller and the difference, and controls the rotation amount of the transfer roller using the correction amount.

6. The recording device according to claim 5, wherein the control device corrects the actual transfer amount of each of the multiple marks depending on a difference between a layer thickness of the printed test chart and a layer thickness of the recording medium.

7. The recording device according to claim 1, wherein when the second detection device detects the multiple marks arranged on the printed test chart that is transferred askew with an angle, the control device corrects the actual transfer amount of each of the multiple marks depending on the angle.

8. The recording device according to claim 7, wherein when the number of counts of the marks detected by the second detection device is less than a set number of counts, the control device determines that the second detection device detects the printed test chart transferred askew with the angle.

9. The recording device according to claim 7, wherein the control device identifies the angle from a difference between the number of counts of the marks detected by the second detection device and a set number of counts and corrects the actual transfer amount of each of the multiple marks according to the angle identified.

10. A method of controlling a recording device that forms images with a print head that discharges ink on a recording medium, comprising:

firstly detecting a rotation position of a transfer roller that transfers the recording medium;

secondly detecting multiple marks arranged on a printed test chart that is used to adjust a transfer amount of the transfer roller; and controlling the transfer roller, said controlling the transfer roller includes:

firstly calculating an difference between an actual transfer amount of each of the multiple marks obtained by a step of secondly detecting rotation position, and a set theoretical transfer amount of each of the multiple marks relating to the rotation position of the transfer roller;

secondly calculating a correction amount to correct the transfer amount of the transfer roller based on a relationship between the rotation position of the transfer roller and the difference; and controlling the transfer amount of the transfer roller using the correction amount, wherein, based on the relationship between the rotation position of the transfer roller and the difference, the control device determines a first difference with regard to a current rotation position of the transfer roller and a second difference with regard to a position after rotation of the transfer roller, and calculates the correction amount from a difference between the first difference and the second difference.

* * * * *